US006006907A

United States Patent [19]

Sato et al.

[11] Patent Number: 6,006,907

[45] **Date of Patent: *Dec. 28, 1999**

[54] WRAPPED ARTICLE

[75] Inventors: Makoto Sato; Takayoshi Ose; Shoichi Aoki, all of Kanagawa-ken; Kazuaki Taga; Satoshi Aramaki, both of Tokyo, all of Japan

[73] Assignee: Fuji Photo Film Co., Ltd., Kanagawa-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/662,183

[22] Filed: Jun. 12, 1996

Related U.S. Application Data

[63] Continuation of application No. 08/221,570, Apr. 1, 1994, abandoned.

[30] Foreign Application Priority Data

| | | | |
|---|---|---|---|
| Apr. 1, 1993 | [JP] | Japan | 5-016104 U |
| Apr. 1, 1993 | [JP] | Japan | 5-016105 U |
| Apr. 1, 1993 | [JP] | Japan | 5-016108 U |

[51] Int. Cl.[6] ..... B65D 85/67

[52] U.S. Cl. ..... 206/387.1; 206/497; 229/87.05

[58] Field of Search ..... 229/87.05, 87.06, 229/87.09, 87.18; 206/525, 264, 268, 387.1, 497

[56] References Cited

U.S. PATENT DOCUMENTS

| | | | |
|---|---|---|---|
| 1,816,835 | 8/1931 | Fischer | 229/87.05 X |
| 2,279,245 | 4/1942 | Phelps | 229/87.05 |
| 3,239,128 | 3/1966 | Rumberger | 229/87.05 X |
| 3,245,525 | 4/1966 | Shoemaker | 206/268 X |
| 3,265,287 | 8/1966 | Hovland | 206/264 |
| 4,782,956 | 11/1988 | Yoshizawa | 206/497 |
| 5,011,014 | 4/1991 | Borck et al. | 206/387.1 |
| 5,048,687 | 9/1991 | Suzuki et al. | 229/87.05 |
| 5,097,955 | 3/1992 | Kluter et al. | 206/387.1 |
| 5,333,735 | 8/1994 | Focke et al. | 229/87.05 X |
| 5,423,423 | 6/1995 | Sato et al. | 229/87.05 X |

FOREIGN PATENT DOCUMENTS 2156303 10/1985 United Kingdom .

*Primary Examiner*—Jacob K. Ackun

*Attorney, Agent, or Firm*—Sughrue, Mion, Zinn Macpeak & Seas, PLLC

[57] ABSTRACT

The outer surface of an article is covered with a wrapping film, and both edges of the film are lap-welded with each other to constitute a body seal section. Both of the upper and lower edges of the film overlap extending out of an article to be wrapped are folded to the inside of the article, whereby upper and lower folded parts are formed. These folded parts overlap with each other, and are bonded and lap-welded together, thereby constituting a side seal section. An unbonded part is formed along the periphery of the upper folded part, wherein the upper folded part and the lower folded part are not bonded together. Two slits are formed in that unbonded part substantially at right angles or an inclined angle to the edge of the upper folded part, and spaced apart from each other by a certain interval. When an interval between the slits is peeled off with a finger, the unbonded part splits along the slits, and hence the side seal section splits. The split made by the slits is extended along the body seal section by pulling the split further toward the inside of the article, whereby the body seal section is removed.

6 Claims, 16 Drawing Sheets

WRAPPED ARTICLE

This is a Continuation of application Ser. No. 08/221,570 filed Apr. 1, 1994 and now abandoned.

BACKGROUND OF THE INVENTION

1. Field of the Invention

This invention relates to an article wrapped with a wrapping film, and more particularly to a wrapped article in such a form that a wrapping film is attached in close contact with an object to be wrapped; for example, a wrapped article which contains one or a number of objects such as a magnetic tape cassette housed in a case.

2. Description of the Prior Art

Of various types of recent commodities arranged in a shop, in the case of relatively small products having a regular shape such as a magnetic tape cassette, the product is wrapped with a transparent or translucent wrapping film coated with cellophane, polyethylene, polypropylene, polyvinylchloride, polyvinylidenechloride, or the like, in order to protect the product from dust or moisture and so maintain a good appearance. These magnetic tape cassettes are shipped as a wrapped article or displayed at the shop as one of packages to be sold en block in which an appropriate number of goods are collectively packed.

As a matter of course, when an article (a product) wrapped in this type of wrapping film is used, it is necessary to remove this wrapping film. In most cases, as shown in FIG. 42, a tearing tape 2 is formed inside the wrapping film, and a constitution for facilitating the removal of the film from an article 10 is generally adopted.

In other words, this tearing tape 2 allows a wrapping film 1 to be appropriately split and separated by pulling an exposed end 2*a* of the tape 2. Slits 3 are formed along this tearing tape in the vicinity of the exposed end 2*a,* thereby facilitating the removal of the tape. With such a constitution, the wrapping film 1 can be split along the tearing tape 2 from the end 2*a*. As a result of this, the wrapping film 1 is split up completely or separated in two.

A wrapping method which is generally called shrink-wrap is widely used for such a wrapping film. In this shrink-wrap, when a wrapping film is attached to an article to be wrapped (i.e. a product), the product is enclosed in the wrapping film while the film is appropriately stretched or heated to a suitable temperature in accordance with material of the film. The wrapping film is tightly attached on to the product because of a contracting action of the film, so that the product is enclosed giving it a good appearance. Such tight attachment of the film to the wrapping film involves a laborious removal action to open the film. Conventionally, several measures are taken to overcome the drawback in the prior art by, for example, forming the tearing tape as mentioned above. This tearing tape was a very effective means.

However, in order to form a tearing tape inside a wrapping film, machines and processes which are dedicated to produce the tearing tape become necessary. In addition, in view of its function, the tearing tape must be sturdier than the wrapping film, and this tearing tape adds to the cost.

Moreover, although it depends on the position of the tearing tape, when the tearing tape is disposed as shown in FIG. 47, a smaller part "a" of the film remaining after the film has been split by the tearing tape is easy to remove. On the other hand, a larger remaining film involves a very laborious removal action in order to get at the actual contents.

SUMMARY OF THE INVENTION

In view of the foregoing descriptions and observations, the object of this invention is to provide a wrapped article which requires neither a special machine nor member and with which it is easy to remove the wrapper from the article by tearing the whole of the wrapping film.

Still another object of this invention is to provide a wrapped article which does not involve the complete separation of a wrapping film into two, as is required in opening the film by a conventional tearing tape, while the film is attached to an article to be wrapped; which enables easy removal of a wrapping film to get at the article; and which yields several advantages such as the removal of a process for forming a tearing tape from production processes and a reduction in material cost because the tearing tape becomes unnecessary.

To these ends, according to a first aspect of this invention, the present invention provides a wrapped article including an article to be wrapped whose outer surface is covered with a wrapping film, a body seal section made by making ends of the wrapping film overlap with each other and bonding them together, and a side seal section produced by making an upper folded part and a lower folded part, both formed by folding the upper and lower edges of the film which extend past the article to the inside of the article, overlap with each other and bonding them together, the improvement comprising:

an unbonded part, formed along the periphery of the upper folded part, where the upper folded part is not adhered to the lower folded part; and two slits formed in the unbonded part at right angles or an inclined angle to the edge of the upper folded part and spaced apart from each other by a given interval.

Here, the term "bonding" used in this specification represents so-called welding, i.e. bonding by heating, as well as adhesion by means of an adhesive throughout the specification.

According to a second aspect of this invention, the present invention provides a wrapped article including an article to be wrapped whose outer surface is covered with a wrapping film, a body seal section made by making ends of the wrapping film overlap with each other and bonding them together, and a side seal section produced by making an upper folded part and a lower folded part, both formed by folding the upper and lower edges of the film which extend past the article to the inside of the side of the article, overlap with each other and bonding them together, the improvement comprising:

one end of the body seal section extending into the upper folded part; and two slits formed with the end of the body seal section sandwiched between them.

According to a third aspect of this invention, the present invention provides a wrapped article including an article to be wrapped whose outer surface is covered with a wrapping film, a body seal section made by making ends of the wrapping film overlap with each other and bonding them together, and a side seal section produced by making an upper folded part and a lower folded part, both formed by folding the upper and lower edges of the film which extend past the article to the inside of the side of the article, overlap with each other and bonding them together, the improvement comprising:

an unbonded part, formed along the periphery of the upper folded part, where the upper folded part is not adhered to the lower folded part; and two slits formed in the unbonded part at right angles or an inclined angle to the edge of the upper folded part and spaced apart from each other by intervals between 5 mm and 50 mm.

According to a fourth aspect of this invention, the present invention provides a wrapped article including an article to be wrapped whose outer surface is covered with a wrapping film, a body seal section made by making ends of the wrapping film overlap with each other and bonding them together, and a side seal section produced by making an upper folded part and a lower folded part, both formed by folding the upper and lower edges of the film which extend past the article to the inside of the side of the article, overlap with each other and bonding them together, the improvement comprising:

one end of the body seal section extending into the upper folded part; and two slits formed with the end of the body seal section sandwiched between them and spaced apart from each other by intervals ranging between 5 mm and 50 mm.

According to any one of the first to the fourth aspects of the present invention, the slit may be provided with a mark to make the slit distinctive and indicate a direction in which the slit is to be peeled off.

According to the first, second, third and fourth aspects of the present invention, the unbonded part is formed along the edge of the upper folded part in the side seal section as mentioned above, and also the slits are formed in this unbonded part. Thereby, when the slit is peeled off, a split developing from this slit stretches in a direction at right angles or an inclined angle to the edge of the side seal section while it moves away from the side seal section. This causes the split having a width corresponding to the interval between the slits to stretch, and hence a user can open the wrapping film wider in a direction substantially at right angles to this split by using the split, whereby the film can be very easily removed such that the entire article is substantially uncovered.

According to a fifth aspect of this invention, the present invention provides a wrapped article including an article to be wrapped whose outer surface is covered with a wrapping film, a body seal section made by making ends of the wrapping film overlap with each other and bonding them together, and a side seal section produced by folding the edges of the film which extend past the article to the inside of the side of the article, making them overlap with each other, and bonding them together, the improvement comprising:

perforations formed around the side seal section in such a way as to surround the side seal section.

According to a sixth aspect of this invention, the present invention provides a wrapped article including an article to be wrapped whose outer surface is covered with a wrapping film, a body seal section made by making ends of the wrapping film overlap with each other and bonding them together, and a side seal section produced by folding the edges of the film which extend past the article to the inside of the side of the article, making them overlap with each other and bonding them together, the improvement comprising:

perforations formed around the side seal section with a part thereof unperforated.

According to a seventh aspect of this invention, the present invention provides a wrapped article including an article to be wrapped whose outer surface is covered with a wrapping film, a body seal section made by making ends of the wrapping film overlap with each other and bonding them together, and a side seal section produced by folding the edges of the film which extend past the article to the inside of the side of the article, making them overlap with each other, and bonding them together, the improvement comprising:

perforations formed around the side seal section with a part thereof unperforated; and the unperforated part remaining at the position corresponding to the body seal section.

In any one of the fifth to the seventh aspects of this invention, at least a part of the perforations may be provided with a slit.

In the fifth to the seventh aspects of this invention, the perforations are formed around the side seal section as set forth above, and hence the wrapping film containing the side seal section can be easily peeled off by separating the perforations. It is possible for a user to easily tear off the wrapping film by means of each separated end of the perforations, and hence a user can open the film much wider by the use of that end as a finger hold. Thus, the wrapping film can be very easily taken away such that the entire article is substantially uncovered.

When the unperforated part is formed at a part of the area surrounding the side seal section, the wrapping film including the side seal section is taken off with the unperforated area remaining, and a user can open the film by the use of this unperforated part as a finger hold. Thus, the unperforated part is considered to be preferable.

When the unperforated part is formed at the position corresponding to the body seal section, the wrapping film can easily open much wider along the body seal section because the body seal section has a strength which is larger than that of the other part of the film.

Moreover, when a slit is formed at least at a part of the perforations, the slit may act as a finger hold when the perforations are separated or when the film is separated from a peeled end of the perforations, whereby the film can be peeled off more easily.

According to an eight aspect of this invention, the present invention provides a wrapped article including an article to be wrapped whose outer surface is covered with a wrapping film, a body seal section made by making ends of the wrapping film overlap with each other and bonding them together, and a side seal section produced by making an upper folded part and a lower folded part, both formed by folding the upper and lower edges of the film which extend past the article to the inside of the side of the article, overlap with each other and bonding them together, the improvement comprising:

a first slit formed on the periphery of the upper folded part in such a way as to extend from that periphery to the inside thereof; and at least one second slit formed on the periphery of the lower folded part and in the vicinity of the first slit in such a way that it extends from the edge of the lower folded part to the inside thereof.

Here, the vicinity of the first slit means both the position that is coincident with the first slit and the position that is slightly spaced apart from the first slit when viewed from above.

According to a ninth aspect of this invention, the present invention provides a wrapped article including an article to be wrapped whose outer surface is covered with a wrapping film, a body seal section made by making ends of the wrapping film overlap with each other and bonding them together, and a side seal section produced by making an upper folded part and a lower folded part, both formed by folding the upper and lower edges of the film which extend past the article to the inside of the side of the article, overlap with each other and bonding them together, the improvement comprising:

a first slit formed on the periphery of the upper folded part in such a way as to extend from that periphery to the inside thereof;

at least one second slit formed on the periphery of the lower folded part and in the vicinity of the first slit in such a way that it extends from the edge of the lower folded part to the inside thereof; and an unbonded part formed around the first or the second slit in the side seal section in such a way that it contains the first or the second slit.

According to a tenth aspect of this invention, the present invention provides a wrapped article including an article to be wrapped whose outer surface is covered with a wrapping film, a body seal section made by making ends of the wrapping film overlap with each other and bonding them together, and a side seal section produced by making an upper folded part and a lower folded part, both formed by folding the upper and lower edges of the film which extend past the article to the inside of the side of the article, overlap with each other and bonding them together, the improvement comprising:

a first slit formed on the periphery of the upper folded part in such a way as to extend from that periphery to the inside thereof; and at least two second slits formed on the periphery of the lower folded part with the first slit interposed between them in such a way that the slits extend from the edge of the lower folded part to the inside thereof.

According to an eleventh aspect of this invention, the present invention provides a wrapped article including an article to be wrapped whose outer surface is covered with a wrapping film, a body seal section made by making ends of the wrapping film overlap with each other and bonding them together, and a side seal section produced by making an upper folded part and a lower folded part, both formed by folding the upper and lower edges of the film which extend past the article to the inside of the side of the article, overlap with each other and bonding them together, the improvement comprising:

a first slit formed on the periphery of the upper folded part in such a way as to extend from that periphery to the inside thereof;

at least two second slits formed on the periphery of the lower folded part with the first slit interposed between them in such a way that the slits extend from the edge of the lower folded part to the inside thereof; and an unbonded part formed around the first or the second slit in the side seal section in such a way that it contains the first or the second slit.

In the eighth to the eleventh embodiments, a mark may be provided in the vicinity of the first slit to make the slit distinctive and indicate a direction in which the slit is to be peeled off.

In the wrapped article as mentioned in the eighth to the eleventh aspects of this invention, the side seal section has a strength which is larger than any other part in the wrapping film. Hence when a fingernail or the like is inserted into the first slit, and when this finger or the like is moved along the side seal section, a split developing from the first slit stretches along the side seal section together with a split developing from the second slit in the vicinity of the first slit. By virtue of this split, the wrapping film opens much wider, and hence the film can be removed such that the entire article is substantially uncovered.

The unbonded part formed around the first or the second slit facilitates the insertion of a fingernail or the like into the first or the second slit, whereby the side seal section can be torn off more easily.

When at least one second slit is formed on each side of the first slit, the side seal section can be torn away irrespective of a direction in which the fingernail or the like inserted into the first slit is moved.

It is more desirable for the first slit to be provided with a mark to make the slit distinctive and indicate a position from which the slit is peeled off.

DETAILED DESCRIPTION OF THE EMBODIMENTS

With reference to the accompany drawings, preferred embodiments of this invention will now be described in detail.

First Embodiment

Figure 1:
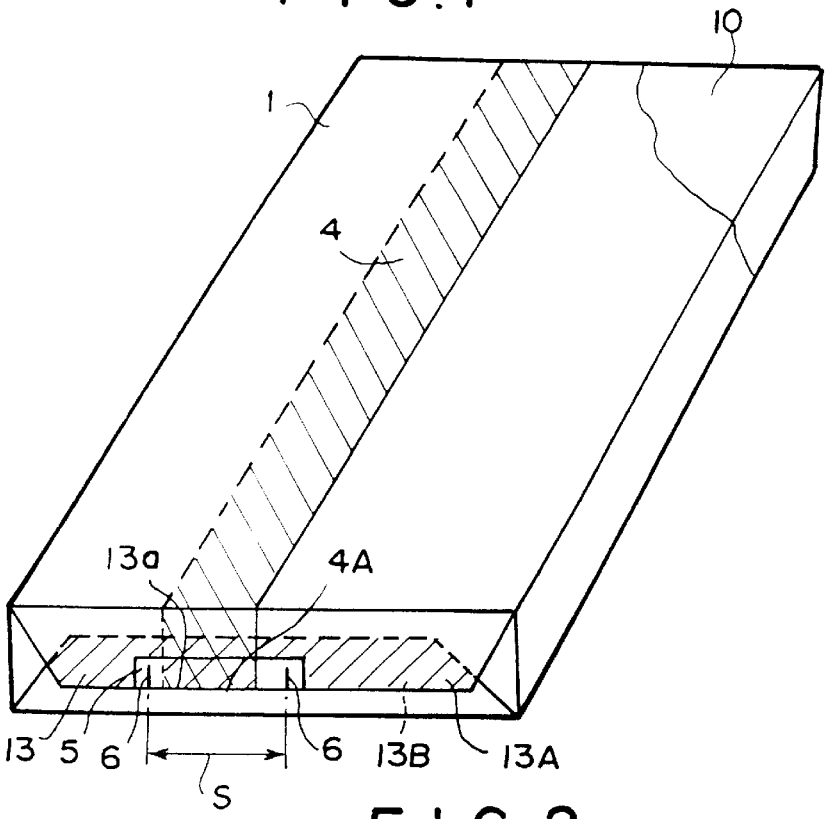
FIG. 1 is schematic representation of a wrapped article according to a first embodiment of this invention.
Figure 2:
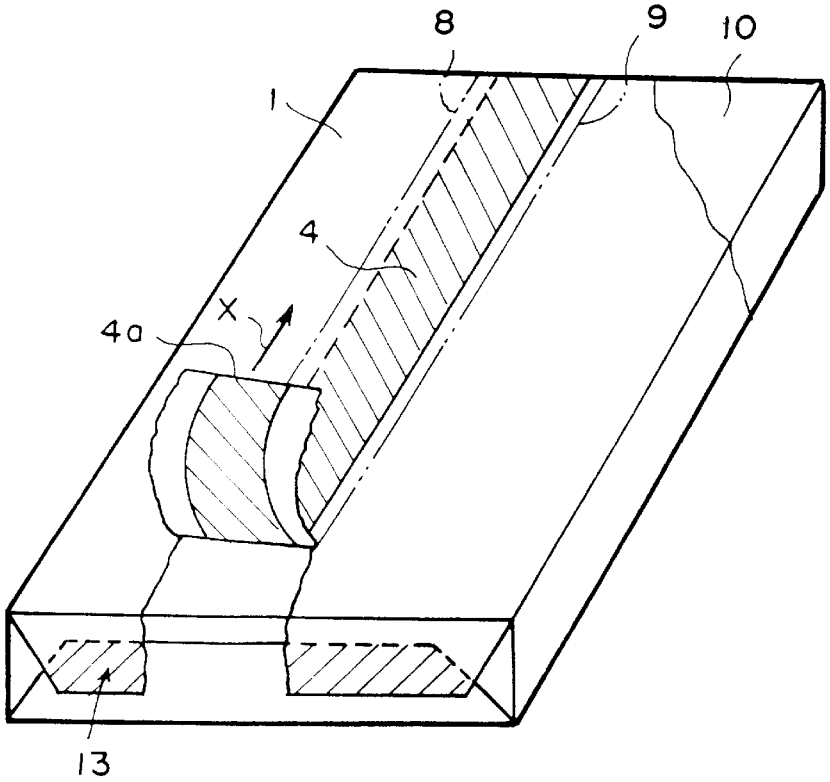
FIG. 2 is a schematic representation of the wrapped article shown in FIG. 1 when a slit thereof is raised.

FIGS. 1 and 2 show a wrapped article according to a first embodiment of this invention, in which a video cassette is enclosed with a wrapping film.

As shown in FIGS. 1 and 2, opposite ends of a wrapping film 1 overlap with each other substantially at the center of a wider surface of a rectangular-parallelepiped-shaped article 10 to be wrapped (when it is contained in a housing case), that is, a video cassette. The overlapping portion of the film is heated and welded together to constitute a body seal section 4 (this body seal is represented by a slanting line throughout the drawings). Both upper and lower ends of the film 1 extending out of the article 10 are folded to the inside of the article, so that an upper folded portion 13A containing the body seal section 4 and a lower folded portion 13B without the body seal section are formed. The upper folded portion 13A and lower folded portion 13B overlap with each other and are lapwelded, thereby constituting a side seal section 13.

An unbonded part 5 is formed on the periphery of the upper folded portion 13A of the side seal section 13 so as to contain the edge 4A of the body seal section 4. In this unbonded part 5, two slits 6 are formed at right angles to the edge 13*a* of the upper folded portion 13A, and are spaced apart from each other by a given interval. The interval between these two slits should preferably be set not less than 5 mm and not more than 50 mm so that the interval can be readily held with a finger.

As shown in FIG. 2, when the intermediate area between the two slits on the edge 13*a* of the upper folded portion 13A is peeled off in an X direction, the unbonded part 5 splits to the edge of the side seal section 13, and hence this side seal section 13 splits. Thereby, the split developing from the slits 6 reaches the surface of the film 1 that continues to the side seal section 13. This split further reaches a wider surface of the article 10. At the body seal section 4, the film 1 is welded into a double layer, and hence the body seal section has a larger strength compared to the rest of the film. This split stretches along imaginary lines 8 and 9 that are substantially parallel to the body seal section 4. Thus, the entire body seal section 4 is substantially torn off, and therefore the wrapping film 1 opens wide as shown in FIG. 3.

Figure 3:
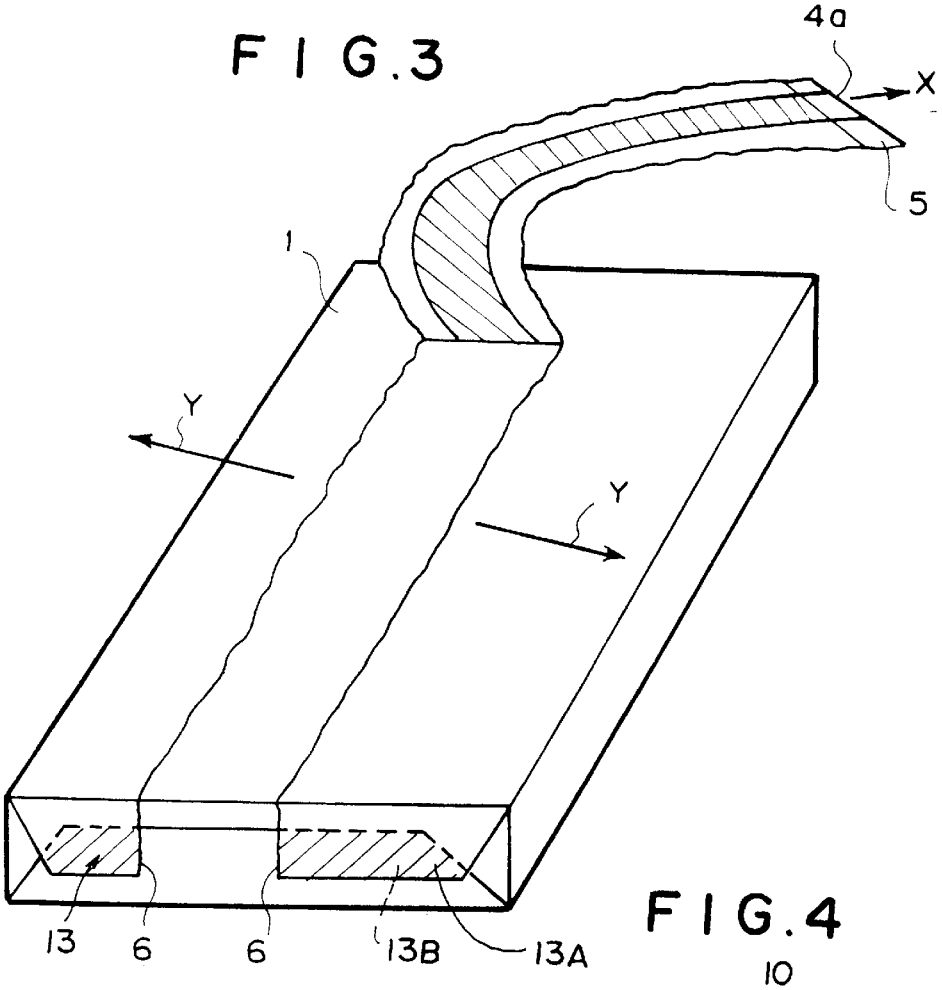
FIG. 3 is a schematic representation of the wrapped article shown in FIG. 1 when the slit is further pulled.

The wrapping film 1 is opened much wider from this split by pulling the remaining film in Y directions as shown in FIG. 3 with the help of this split. Thus, it is possible to very easily remove the film 1 such that the entire article 10 is substantially uncovered.

In the case of an existing wrapped article, it is relatively difficult for a user to remove a larger piece of film remaining after the film has been separated by the use of a tearing tape. Compared with this, the wrapped article of this invention enables a very effective removal operation, and also eliminates the necessity to use the tearing tape. This renders the wrapped article very cost effective.

Though the slits 6 may be formed after the article 10 is packaged, it is desirable for the slits 6 to be made before the article 10 is packaged, thus removing the risk of damage to the article 10 by a cutting knife, etc.

Second Embodiment

Figure 4:
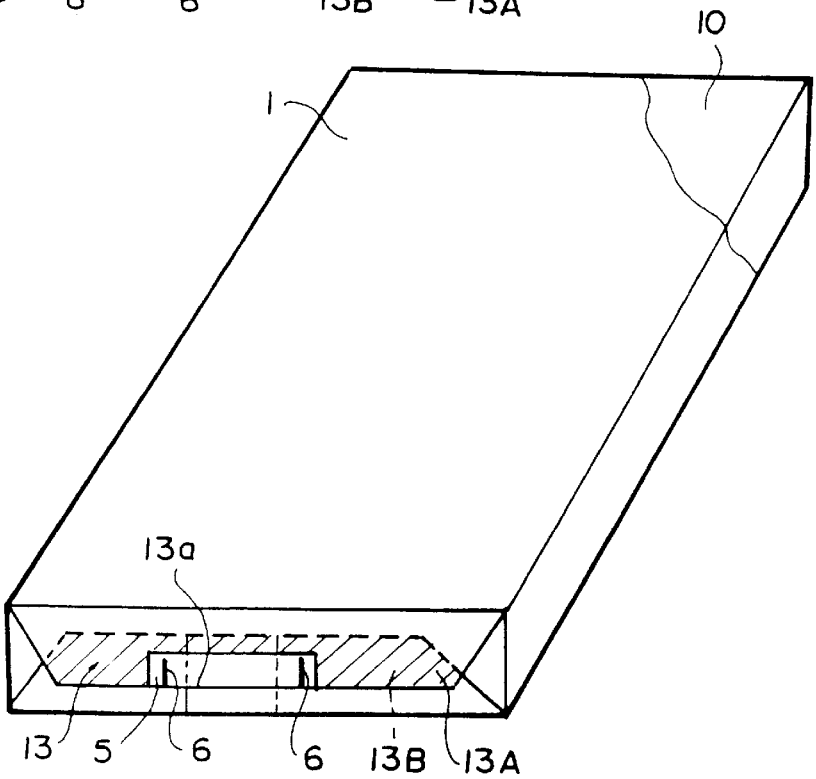
FIG. 4 is a schematic representation of a wrapped article according to a second embodiment of this invention.
Figure 5:
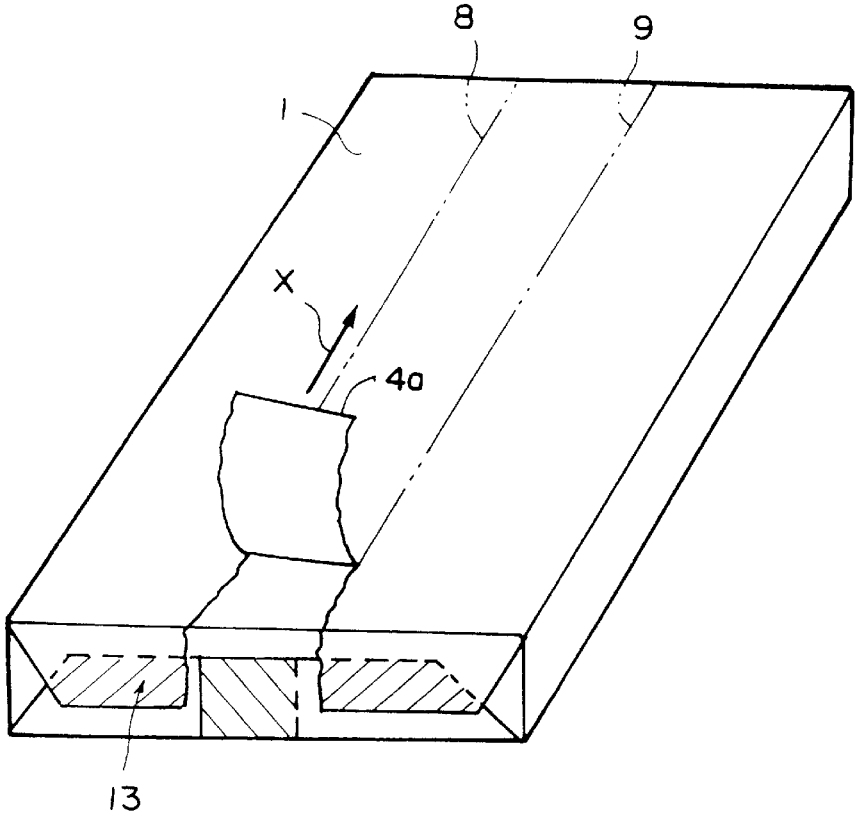
FIG. 5 is a schematic representation of the wrapped article shown in FIG. 4 when a slit thereof is raised.

A second embodiment of this invention will now be described. FIGS. 4 and 5 show a wrapped article according to a second embodiment of this invention. As shown in FIGS. 4 and 5, the wrapped article of this embodiment is provided with the body seal section 4 in the same manner as in the first embodiment. Both ends of the film 1 extending out of the article 10 are folded to the inside of the article, so that the upper folded portion 13A containing the body seal section 4 and the lower folded portion 13B without the body seal section are formed. These upper folded portion 13A and the lower folded portion 13B overlap with each other and are lap-welded, thereby constituting the side seal section 13.

As with the first embodiment, the unbonded part 5 is formed on the periphery of the upper folded portion 13A of the side seal section 13. In this unbonded part 5, two slits 6 are formed at right angles to the edge 13*a* of the upper folded portion 13A, and are spaced apart from each other by a given interval.

As shown in FIG. 5, when the intermediate area between the two slits on the edge 13*a* of the upper folded portion 13A is peeled off in the X direction, the unbonded part 5 splits to the edge of the side seal section 13, and hence this side seal section 13 splits. Thereby, the split developing from the slits 6 reaches the surface of the film 1 that continues to the side seal section 13. This split then reaches a wider surface of the article 10 and stretches along imaginary lines 8 and 9.

Differing from the first embodiment, the split arising from the slits 6 does not stretch along the body seal section 4 in this embodiment, and hence there is a possibility of the split coming to an end on its way across a wider surface of the article. However, if the wrapping film 1 over a wider surface of the article is torn off to a certain degree, it is possible for a user to peel the remaining film in a direction substantially at right angles to the split. This makes it possible to very easily remove the film 1 such that the entire article 10 is substantially uncovered.

Third Embodiment

Figure 6:
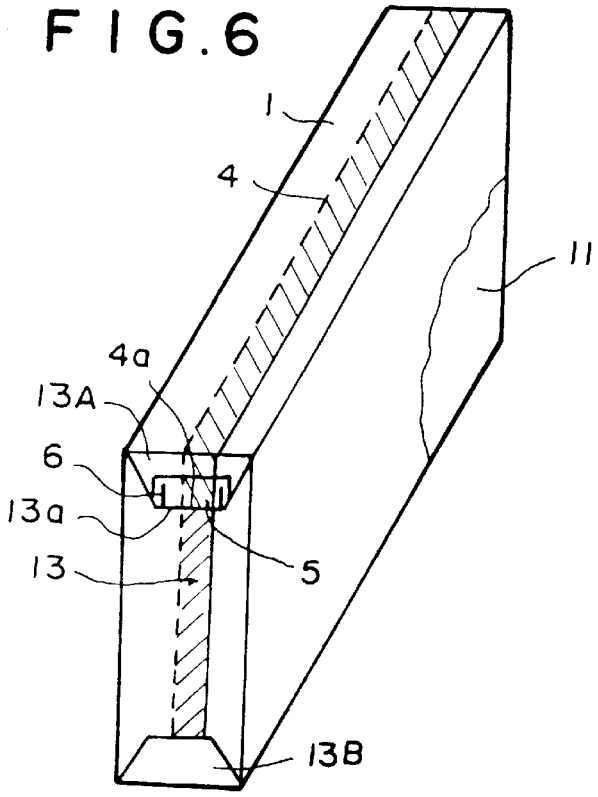
FIG. 6 is a schematic representation of a wrapped article according to a third embodiment of this invention.
Figure 7:
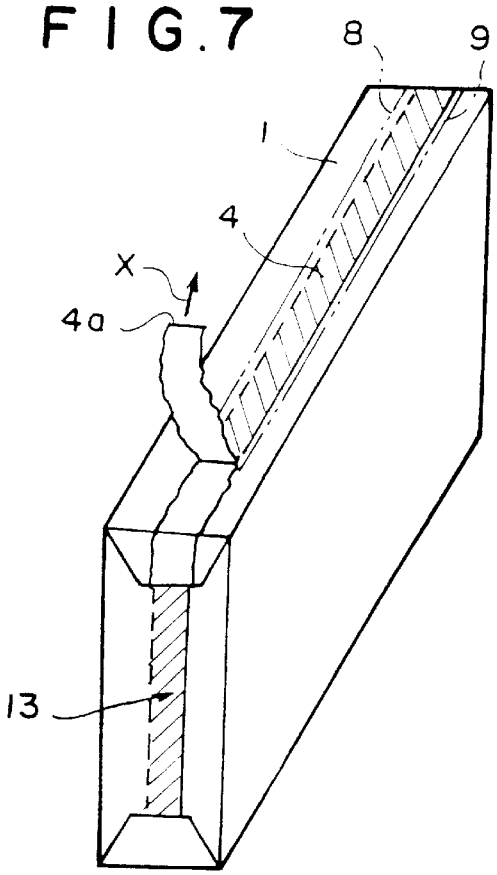
FIG. 7 is a schematic representation of the wrapped article shown in FIG. 6 when a slit thereof is raised.

A third embodiment of this invention will now be described. FIGS. 6 and 7 show a wrapped article according to a third embodiment of this invention, in which an audio cassette is enclosed, as an article to be wrapped, in a wrapping film. As shown in the drawings, both ends of the wrapping film 1 overlap with each other substantially at the center of a narrow lateral surface of an audio cassette 11 (the cassette is housed in a case) which serves as the article to be wrapped, and heated and lap-welded together to constitute the body seal section 4. Both ends of the film 1 extending out of the article 11 are folded to the inside of the article, so that the upper folded portion 13A containing the body seal section 4 and the lower folded portion 13B without the body seal section are formed. These upper folded portion 13A and the lower folded portion 13B overlap with each other and are lap-welded, thereby constituting the side seal section 13.

The unbonded part 5 is formed on the periphery of the upper folded portion 13A of the side seal section 13 so as to contain the edge 4A of the body seal section 4. In this unbonded part 5, two slits 6 are formed at right angles to the edge 13*a* of the upper folded portion 13A, and are spaced apart from each other by a given interval.

As shown in FIG. 7, when the intermediate area between the two slits 6 on the edge 13*a* of the upper folded portion 13A is peeled off in the X direction, the unbonded part 5 splits to the edge of the side seal section 13, and hence this side seal section 13 splits. Thereby, the split developing from the slits 6 reaches the surface of the film 1 that continues to the side seal section 13. This split further reaches the surface of the article 10 on which the body seal section 4 is formed. At the body seal section 4, the film 1 is welded into a double layer, and hence the body seal section has a larger strength compared to the rest part of the film. This split stretches along imaginary lines 8 and 9 that are substantially parallel to the body seal section 4. Thus, the entire body seal section 4 is substantially torn off, and therefore the wrapping film 1 opens wide.

The wrapping film 1 is opened much wider from this split by pulling the remaining film in Y directions with the help of this split in the same fashion as in the first embodiment. Thus, it is possible to very easily remove the film 1 such that the entire article 11 is substantially uncovered.

Fourth Embodiment

Figure 8:
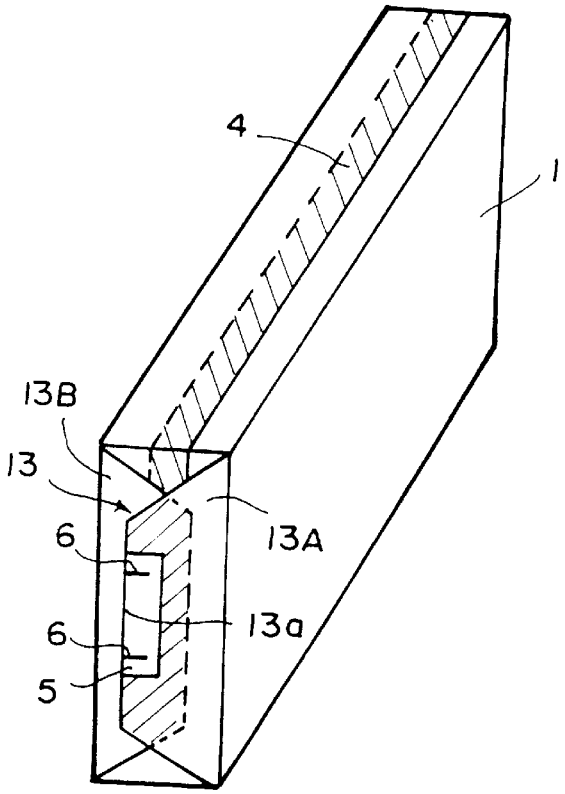
FIG. 8 is a schematic representation of a wrapped article according to a fourth embodiment of this invention.

A fourth embodiment will now be described. FIG. 8 shows a wrapped article according to a fourth embodiment of this invention, in which an audio cassette is enclosed, as an article to be wrapped, in a wrapping film. As shown in the drawing, as with the third embodiment, both ends of the wrapping film 1 overlap with each other substantially at the center of a narrow lateral surface of the audio cassette 11 (the cassette is housed in a case) which serves as the article to be wrapped, and heated and lap-welded together to constitute the body seal section 4. Both ends of the film 1 extending out of the article 11 are folded to the inside of the article, so that the upper folded portion 13A containing the body seal section 4 and the lower folded portion 13B without the body seal section are formed. These upper folded portion 13A and the lower folded portion 13B overlap with each other and are lap-welded, thereby constituting the side seal section 13.

The unbonded part 5 is formed on the periphery of the upper folded portion 13A of the side seal section 13. In this unbonded part 5, two slits 6 are formed at right angles to the edge 13*a* of the upper folded portion 13A, and are spaced apart from each other by a given interval.

In the same fashion as in the previous embodiments, when the intermediate area between the two slits 6 on the edge 13*a* of the upper folded portion 13A is peeled off, the unbonded part 5 splits to the edge of the side seal section 13, and hence this side seal section 13 splits. Thereby, the split developing from the slits 6 reaches the surface of the film 1 that continues to the side seal section 13. This split further reaches a wider surface of the article 10.

Differing from the first embodiment, the split arising from the slits 6 does not stretch along the body seal section 4 in this embodiment, and hence there is a possibility of the split coming to an end on its way across a wider surface of the article. However, as with the second embodiment, if the wrapping film 1 over a wider surface of the article is torn off to a certain degree, it is possible for a user to peel the remaining film in a direction substantially at right angles to the split. This makes it possible to very easily remove the film 1 such that the entire article 10 is substantially uncovered. Thus, no problems will arise even if the split comes to an end on its way across the wrapping film.

Figure 9:
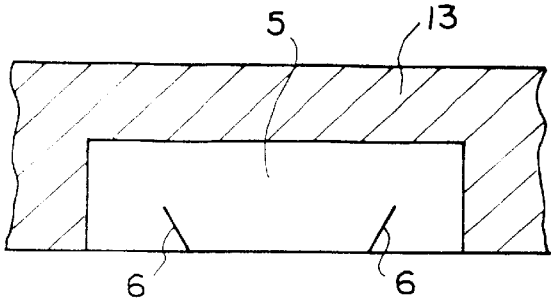
FIG. 9 is a schematic representation of another type of slit according to the first to the fourth embodiments of this invention.
Figure 10:
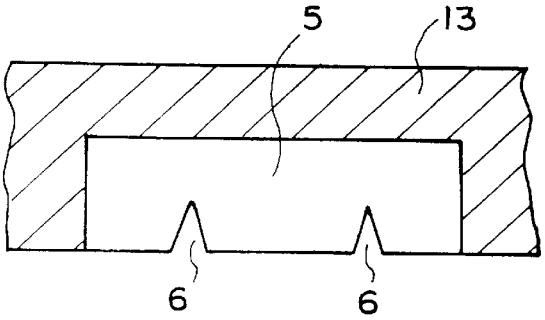
FIG. 10 is a schematic representation of still another type of slit according to the first to the fourth embodiments of this invention.

In the previous embodiments, the slits are formed substantially at right angles to the edge of the body seal. However, as shown in FIG. 9, the slits 6 may be formed at an inclined angle to the edge of the unbonded part 5. In this way, when the slits are formed at an inclined angle, a possibility that the split developing from the slits 6 comes to an end on its way across the article will be eliminated.

Though the slits are linearly formed in the previous embodiments, the slit 6 may be V-shaped to facilitate the peeling of the slit 6 with fingers. The shape of this slit can be also applied to the second, third and fourth embodiments.

In the previous embodiments, the interval between the two slits is set to between 5 and 50 mm, but this is not limited to such a size. So long as the interval between the slits is easy to hold, the interval may be set to any size.

Figure 11:
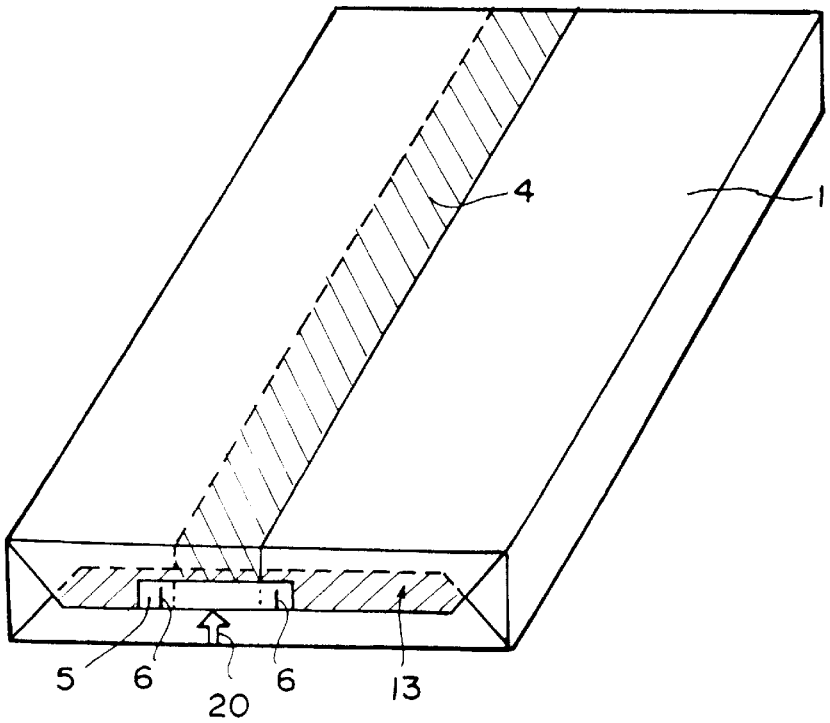
FIG. 11 is a schematic representation showing the wrapped article according to the first to the fourth embodiments of this invention when the slit thereof is provided with a mark.

In order to make distinctive the position of the slit and a direction in which the slit is to be peeled off, the wrapping film may be provided with a mark 20, for example, an arrow to indicate the position of the slit as shown in FIG. 11.

In the previous embodiments, parallelepiped-shaped articles such as the video cassette and the audio cassette are used as the article to be wrapped. However, the article is not limited to these. The article according to this invention can be applied to articles in any shapes such as a sphere, a rectangular parallelepiped, a cylinder, or a circular cone, so long as they can be enclosed with a wrapping film.

Still other embodiments will now be described.

Fifth Embodiment

Figure 12:
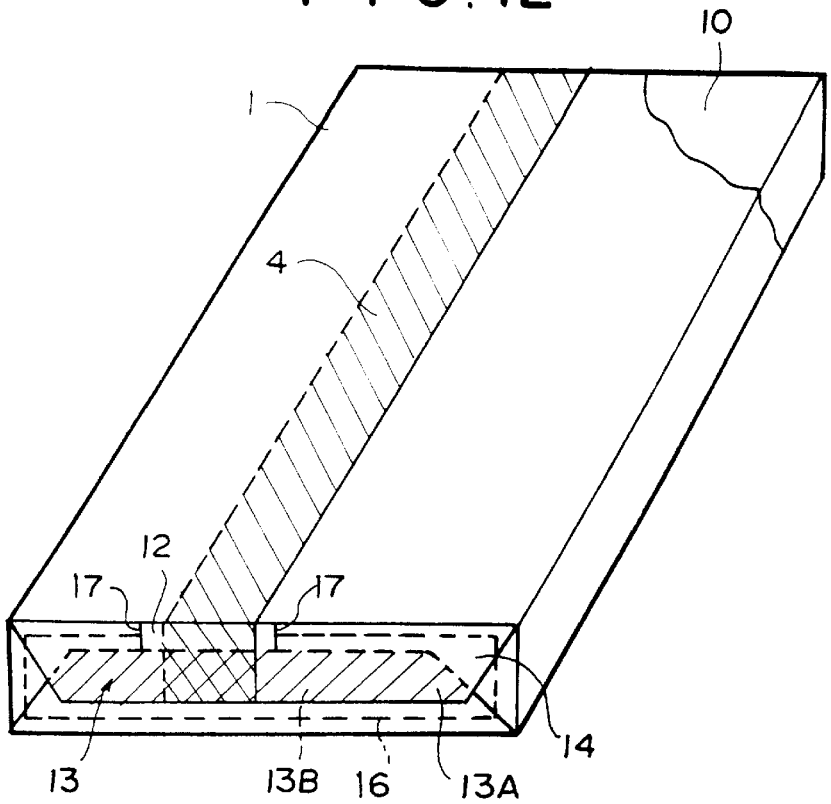
FIG. 12 is a schematic representation of a wrapped article according to a fifth embodiment of this invention.
Figure 13:
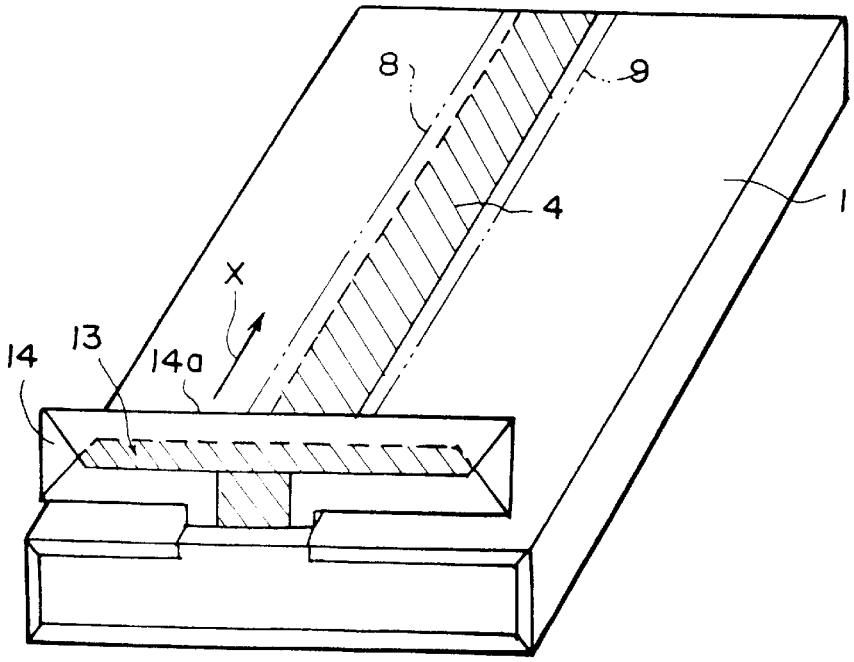
FIG. 13 is a schematic representation of the wrapped article shown in FIG. 12 when a perforated area thereof is partially raised.

FIGS. 12 and 13 show a wrapped article according to a fifth embodiment of this invention, in which a video cassette is enclosed, as an article to be wrapped, in a wrapping film.

In the drawings, a wrapped state of the wrapping film 1 is the same as in the first and second embodiments, and hence detailed descriptions thereof will be omitted. On the surface where the side seal section 13 is formed, perforations 16 are formed around the side seal section 13 while the area of the upper folded portion 13A of the side seal section 13 corresponding to the position of the body seal section 4 is unperforated to constitute an unperforated area 12. Moreover, two slits 17 are formed at the boundary where the perforations 16 and the unperforated area 12 meet with each other at right angles to a direction in which the perforations 16 are formed.

Figure 15:
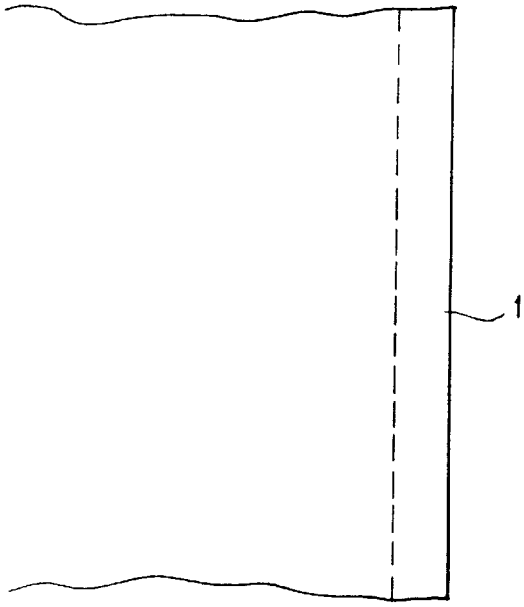
FIG. 15 is a schematic representation of perforations formed in a wrapping film.

As shown in FIG. 15, in the case of this wrapped article, the perforations 16 are linearly formed, by means of a cutting machine or the like, at a position spaced a given distance away from the edge of the film 1 in the area of the film which will extend out of the article and will be used as folded ends before the article 10 is wrapped with the film 1. It is possible to position the perforations 16 in such a way as to surround the side seal section 13 by folding that extended area of the film in the same manner as previously mentioned. Thus, the perforations 16 can be easily formed on the wrapping film 1.

Initially, a force is exerted to an arbitrary position in a perforated area 14 of the film 1 surrounded by the perforations 16 in such a direction that the perforated area slides over the article 10, or an arbitrary portion of the perforations 16 is scratched. As a result of this, a part of the perforations 16 is separated, and this separated part is used as a finger hold. With this separated part, all of the perforations 16 are then separated, and hence the perforated area 14 is then removed. In this state, the perforated area 14 still continues to the remaining part of the film 1 by way of the unperforated area 12.

Subsequently, as shown in FIG. 13, when a part 14*a* of the perforated area 14 is pulled in an X direction, the perforated area 14 splits along the two slits 17, and this split further reaches a rectangular-parallelepiped-shaped wider surface of the article 10. At the body seal section 4, the wrapping film 1 is welded into a double layer, and hence the body seal section has a larger strength compared to the rest of the film 1. This split stretches along imaginary lines 8 and 9 that are substantially parallel to the body seal section 4. This causes the body seal section 4 to be removed substantially completely, and hence the film 1 is opened much wider as shown in FIG. 14.

Figure 14:
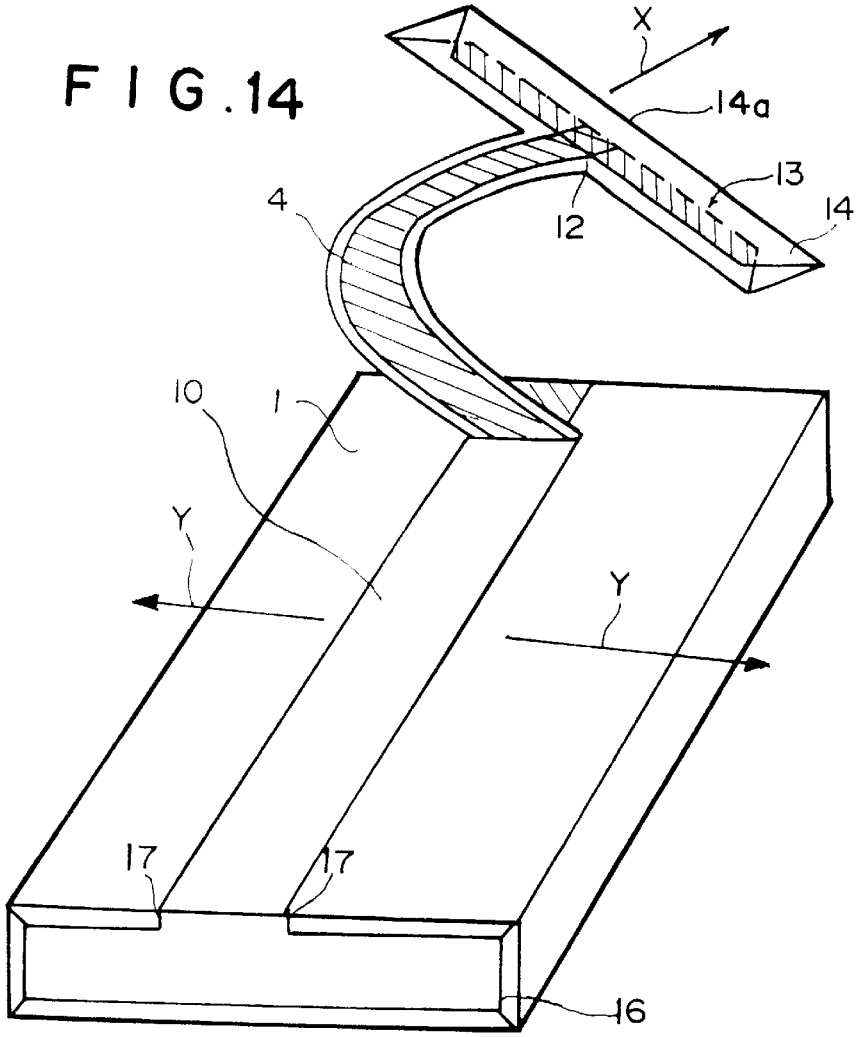
FIG. 14 is a schematic representation of the wrapped article shown in FIG. 12 when the perforated area is further pulled.

The split thus made is pulled in a Y direction as shown in FIG. 14, so that the wrapping film 1 is opened much wider from this split. Thereby, the film 1 can be very easily removed such that the entire article 10 is substantially completely uncovered.

In the case of an existing wrapped article, it is relatively difficult for a user to remove a larger piece of film remaining after the film has been separated by the use of a tearing tape. Compared with this, the wrapped article of this invention enables a very effective removal operation, and also eliminate the necessity to use the tearing tape. This renders the wrapped article very cost effective.

Though the slits 17 may be formed after the article 10 has been packed, it is desirable for the slits 17 to be made before the article 10 is packaged, thus removing the risk of damage to the article 10 by a cutting knife, etc.

Sixth Embodiment

Figure 16:
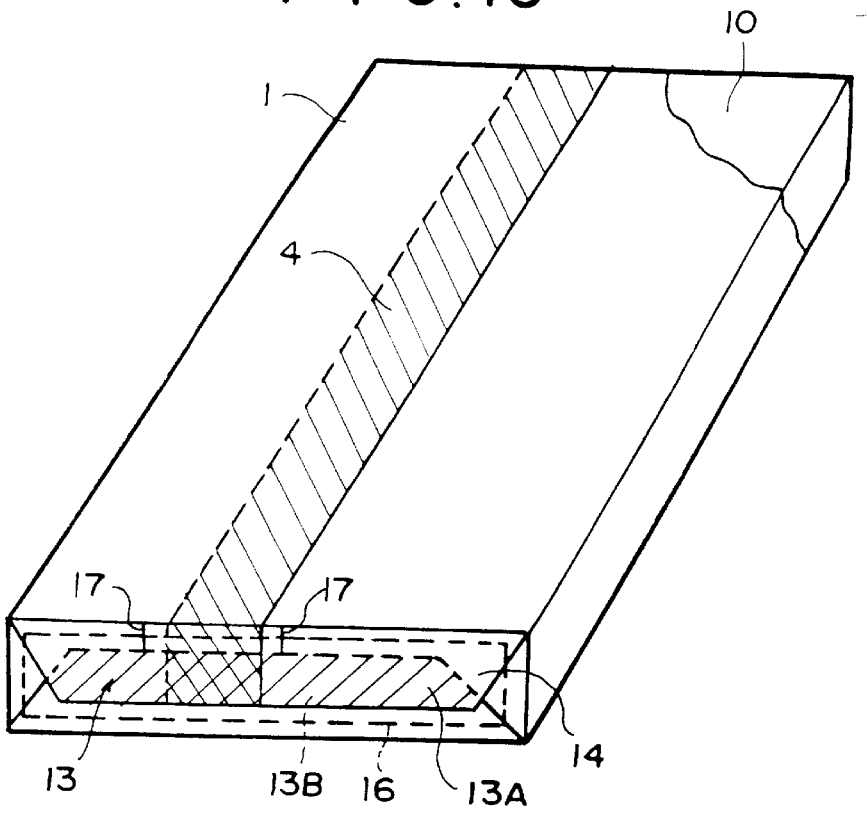
FIG. 16 is a schematic representation of a wrapped article according to a sixth embodiment of this invention.
Figure 17:
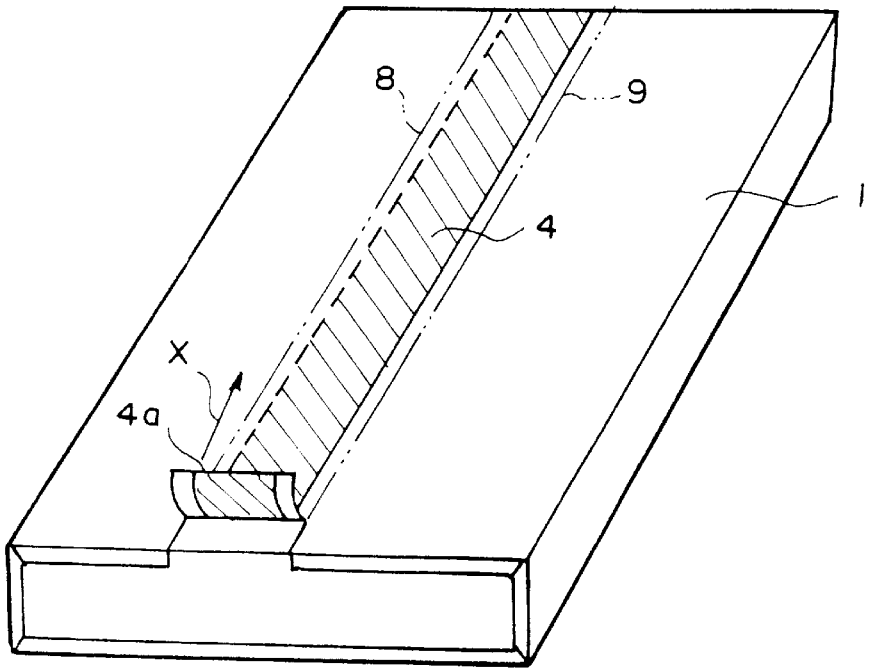
FIG. 17 is a schematic representation of the wrapped article shown in FIG. 16 when the separated end of the perforations is raised.

A sixth embodiment of this invention will now be described. FIGS. 16 and 17 show a wrapped article according to this embodiment. As shown in the drawings, the wrapped article is provided with the body seal section 4 and the side seal section 13 in the same manner as in the previously mentioned fifth embodiment.

On the surface where the side seal section 13 is formed, perforations 16 are formed around the side seal section 13. Moreover, two slits 17 are formed in a part of the perforations 16 such that the slits are opposite to each other with the body seal section 14 interposed between them at right angles to a direction in which the perforations 16 are formed.

Initially, a force is exerted to an arbitrary position in the perforated area 14 of the film 1 surrounded by the perforations 16 in such a direction that the perforated area slides over the article 10, or an arbitrary portion of the perforations 16 is scratched. As a result of this, a part of the perforations 16 is separated, and this separated part is used as a finger hold. With this separated part, all of the perforations 16 are then separated, and hence the perforated area 14 is then removed.

Subsequently, as shown in FIG. 17, when a part sandwiched between the two slits 17 after the perforated area 14 has been removed, that is, a part 14*a* of the perforated area 14 is pulled in an X direction, the split reaches a rectangular-parallelepiped-shaped wider surface of the article 10. Then, the split stretches along the imaginary lines 8 and 9. At the body seal section 4, the wrapping film 1 is welded into a double layer, and hence the body seal section has a larger strength compared to the rest of the film 1. This split stretches along imaginary lines 8 and 9 that are substantially parallel to the body seal section 4. This causes the body seal section 4 to be removed substantially completely, and hence the film 1 is opened much wider in the same manner as in the fifth embodiment. Thereby, it becomes possible to very easily remove the film 1 in such a way that the entire article 10 is substantially completely uncovered.

Seventh Embodiment

Figure 18:
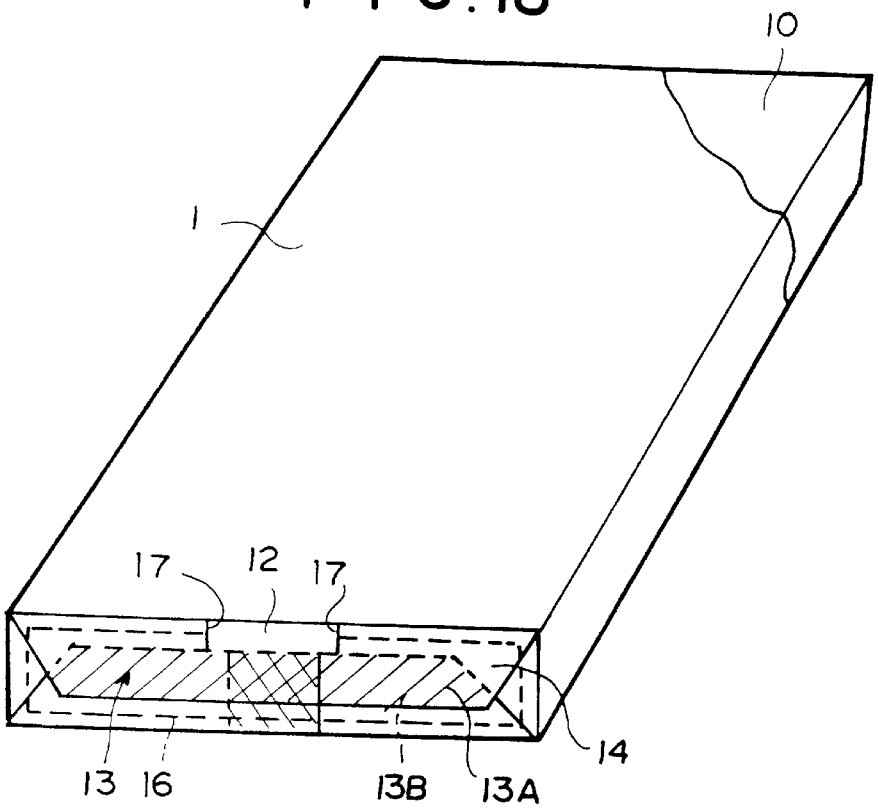
FIG. 18 is a schematic representation showing a wrapped article according to a seventh embodiment of this invention.
Figure 19:
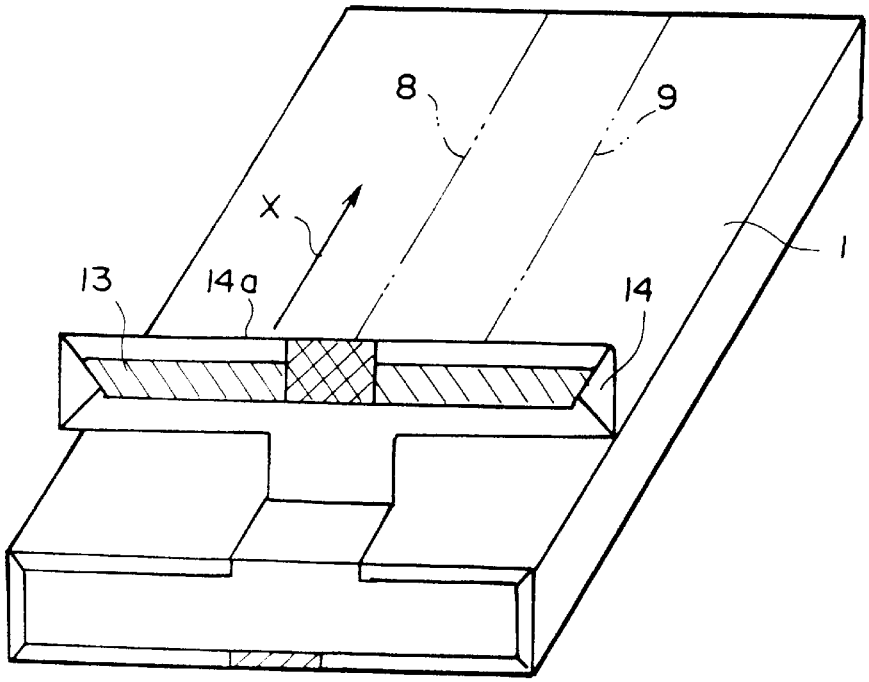
FIG. 19 is a schematic representation of the article shown in FIG. 18 when a perforated area thereof is partially raised.
Figure 20:
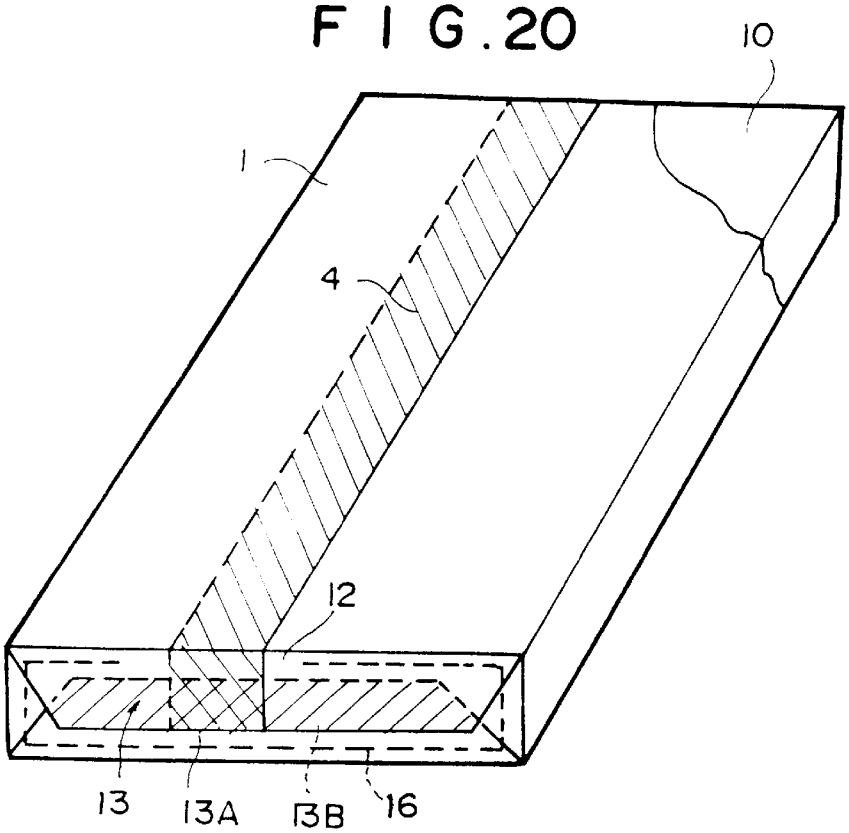
FIG. 20 is a schematic representation of a wrapped article without perforations according to the seventh embodiment of this invention.

A seventh embodiment will now be described. FIGS. 18 and 19 show a wrapped article according to this embodiment. As shown in the drawings, the wrapped article is provided with the body seal section 4 and the side seal section 13 in the same manner as in the foregoing fifth embodiment. In this embodiment, however, the body seal section is included in the lower folded portion 13B.

On the surface where the side seal section 13 is formed, the perforations 16 are formed around the side seal section 13 while the area of the upper folded portion 13A of the side seal section 13 corresponding to the position of the body seal section 4 is unperforated to constitute an unperforated area 12. Moreover, the two slits 17 are formed at the boundary where the perforations 16 and the unperforated area 12 meet with each other.

Initially, in the same way as in the fifth and sixth embodiments, a force is exerted to an arbitrary position in a perforated area 14 of the film 1 surrounded by the perforations 16 in such a direction that the perforated area slides over the article 10, or an arbitrary portion of the perforations 16 is scratched. As a result of this, a part of the perforations 16 is separated, and this separated part is used as a finger hold. With this separated part, all of the perforations 16 are then separated, and hence the perforated area 14 is then removed. In this state, the perforated area 14 still continues to the remaining part of the film 1 by way of the unperforated area 12.

Subsequently, as shown in FIG. 19, when the part 14*a* of the perforated area 14 is pulled in the X direction, the perforated area 14 splits along the two slits 17, and this split further reaches a rectangular-parallelepiped-shaped wider surface of the article 10 and stretches along the imaginary lines 8 and 9.

Differing from the fifth and sixth embodiments, the split arising from the slits 17 does not stretch along the body seal section 4 in this embodiment, and hence there is a possibility of the split coming to an end on its way across a wider surface of the article. However, if the wrapping film 1 over a wider surface of the article is torn off to a certain degree, it is possible for a user to peel the remaining film from that split. This makes it possible to very easily remove the film 1 such that the entire article 10 is substantially uncovered. Thus, no problems will arise even if the split comes to an end on its way across the wrapping film.

Eighth Embodiment

Figure 21:
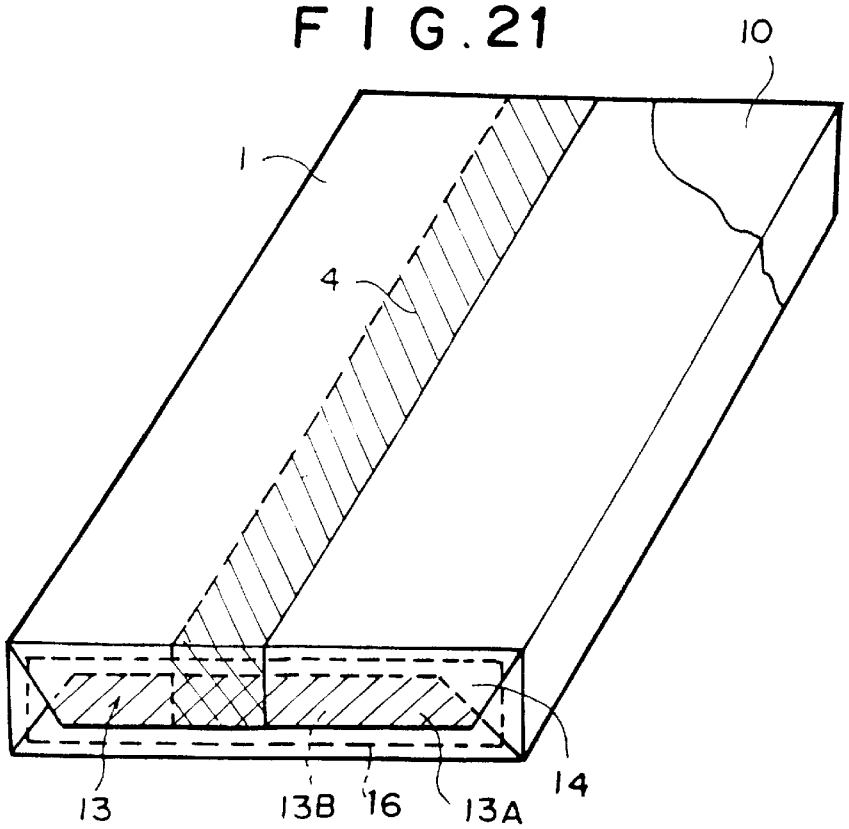
FIG. 21 is a schematic representation of a wrapped article according to an eighth embodiment of this invention.
Figure 22:
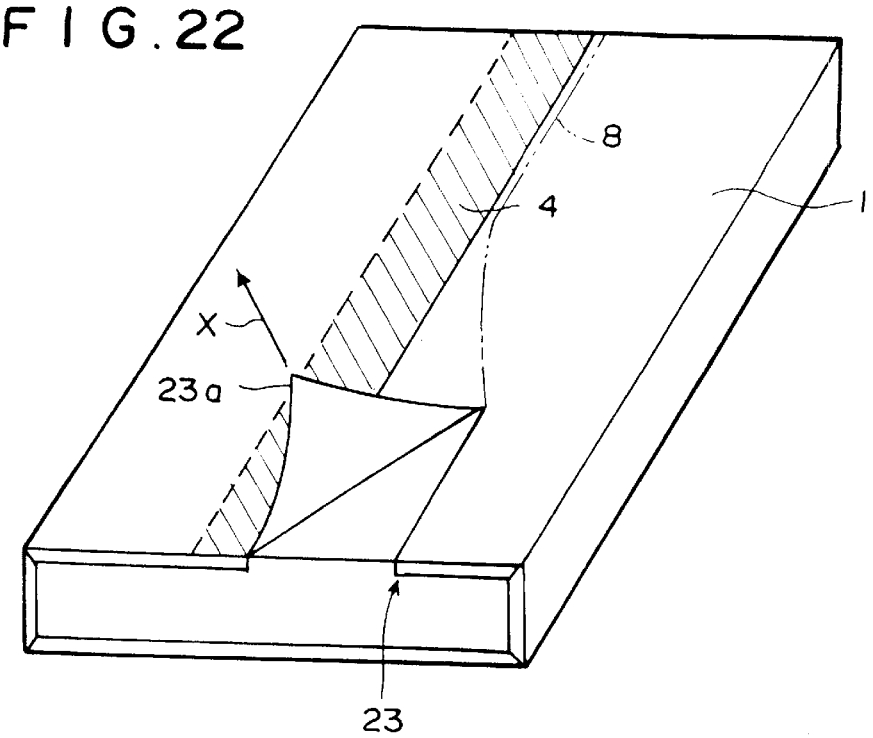
FIG. 22 is a schematic representation of the article shown in FIG. 21 when a perforated area thereof is partially raised.

An eighth embodiment will now be described. FIGS. 21 and 22 show a wrapped article according to this embodiment. In the drawings, the wrapped article is provided with the body seal section 4 and the side seal section 13 in the same manner as in the foregoing fifth embodiment.

On the surface where the side seal section 13 is formed, perforations 16 are formed around the side seal section 13.

Initially, in the same fashion as in the fifth, sixth and seventh embodiments, a force is exerted to an arbitrary position in the perforated area 14 of the film 1 surrounded by the perforations 16 in such a direction that the perforated area slides over the article 10, or an arbitrary portion of the perforations 16 is scratched. As a result of this, a part of the perforations 16 is separated, and this separated part is used as a finger hold. With this separated part, all of the perforations 16 are then separated, and hence the perforated area 14 is then removed.

Figure 23:
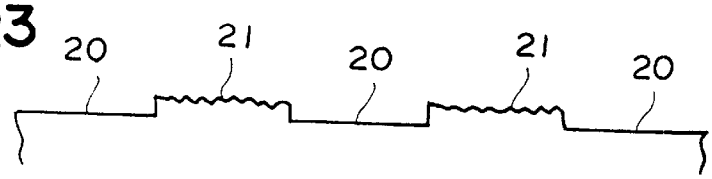
FIG. 23 is an enlarged view of the end of perforations.

As illustrated in FIG. 23, parts 20 separated by a cutting knife and torn-off parts 21 are alternately formed along the separated edge of the perforations 16. With the use of the separated edge of the perforations 16 as a finger hold, the wrapping film 1 can be easily separated.

A part 23 of the separated edge of the perforations 16 is torn away as shown in FIG. 22, and a piece 23*a* of this separated edge is peeled in the X direction, the split developing from the separated edge 23 stretches along the imaginary line 8, and reaches the body seal section 4. Since the body seal section 4 has a larger strength compared to the rest of the wrapping film 1, this split further extends along the body seal section 4. The body seal section 4 is then substantially completely removed, and the wrapping film 1 is opened much wider. Thereby, the film 1 can be very easily removed such that the entire article 10 is substantially uncovered.

Figure 24:
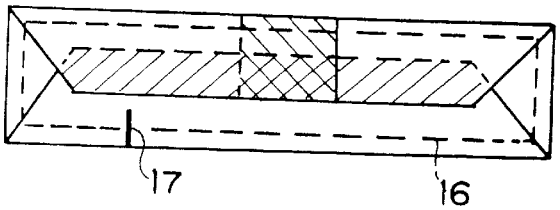
FIG. 24 is a schematic representation of another type of slit according to the fifth to the eighth embodiments of this invention.
Figure 25:
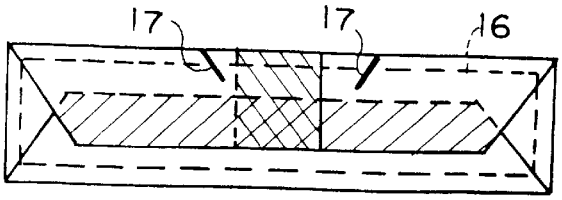
FIG. 25 is a schematic representation of still another type of slit according to the fifth to the eighth embodiments of this invention.

In the fifth to the eighth embodiments, two slits are formed. However, as shown in FIG. 24, only one slit 17 may be formed instead of two. Even in this case, it is possible to open the wrapping film wide with the use of the slit 17 as a finger hold after the perforated area has been separated. Hence, as with the previous embodiments, the wrapping film 1 can be torn off.

Figure 26:
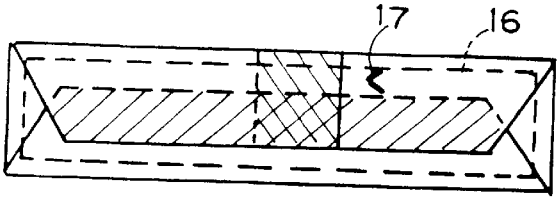
FIG. 26 is a schematic representation of still another type of slit according to the fifth to the eighth embodiments of this invention.

In the fifth to the eighth embodiments, the slits are linearly formed, the slit 17 may be, for example, V-shaped to facilitate the peeling of the slit 17 with fingers as shown in FIG. 26. The shape of the slit shown in FIG. 26 is more preferable because it makes the perforations 16 easy to separate.

The position of the unperforated area formed on the wrapped article according to this invention is not limited to that shown in the fifth to the eighth embodiments. The unperforated area may be formed at any position so long as it is located in a part of the periphery of the side seal section. Moreover, the position, number and shape of the slit is not limited to the previous embodiment, and as many slits as necessary may be formed at any position and in any shape so long as they are formed in a part of the perforations.

In the fifth to the eighth embodiments, parallelepiped-shaped articles such as the video cassette and the audio cassette are used as the article to be wrapped. However, the article is not limited to them. The article according to this invention can be applied to articles in any shape such as a sphere, a rectangular parallelepiped, a cylinder, or a circular cone, so long as they can be enclosed with a wrapping film.

Still other embodiments will now be described.

Ninth Embodiment

Figure 27:
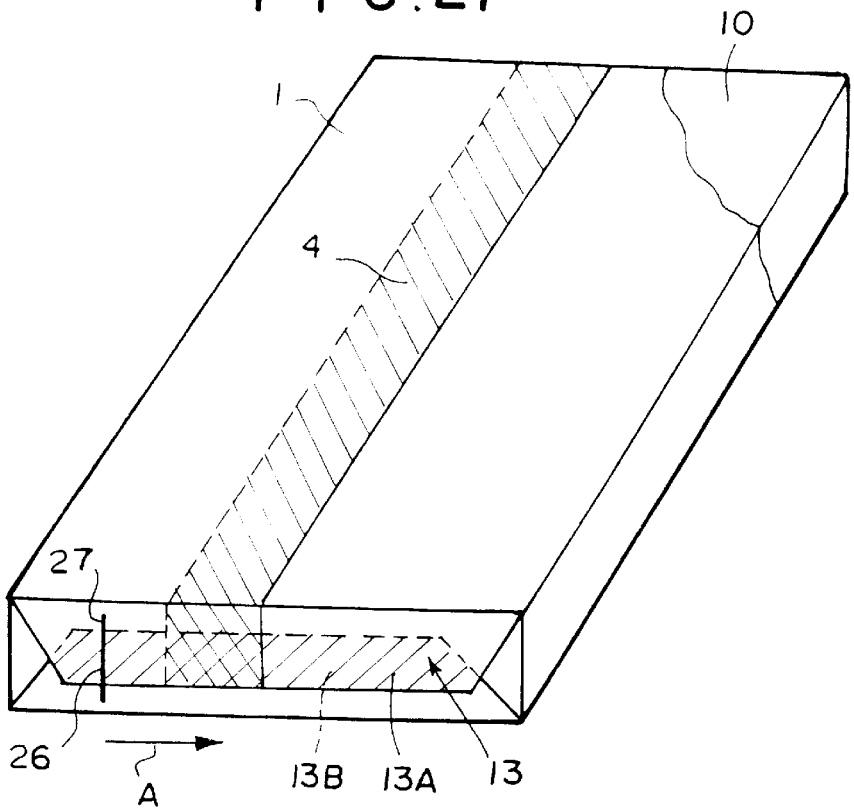
FIG. 27 is a schematic representation of a wrapped article according to a ninth embodiment of this invention.
Figure 28:
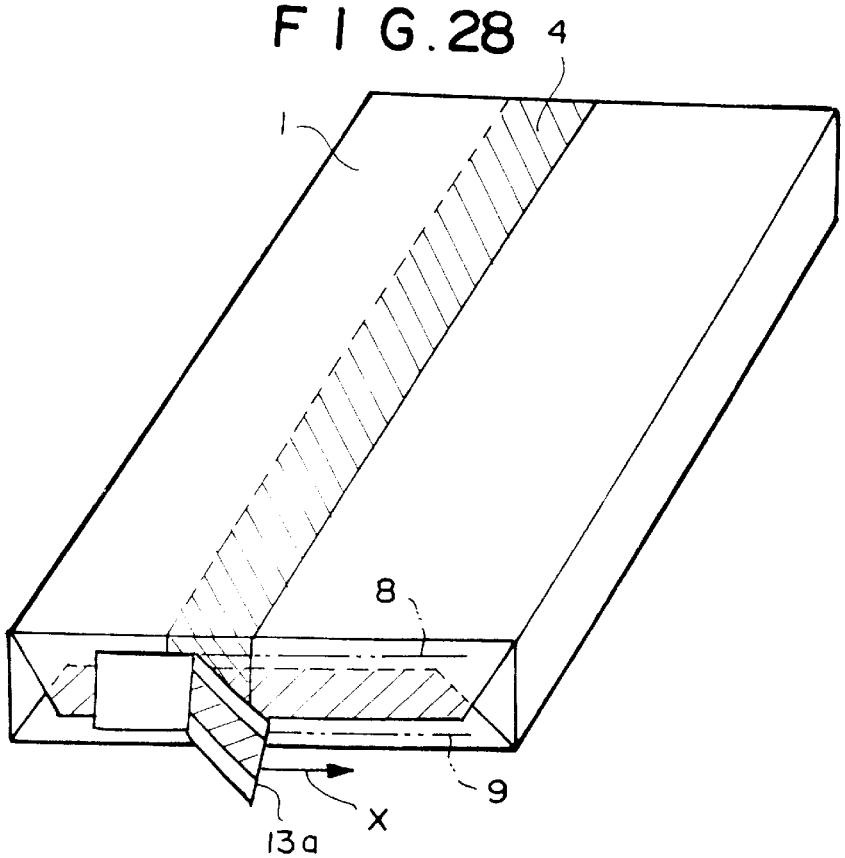
FIG. 28 is a schematic representation of the article shown in FIG. 27 when the split end of a side seal section is raised.

A ninth embodiment will now be described. FIGS. 27 and 28 show a wrapped article according to this embodiment, in which a video cassette is enclosed, as an article to be wrapped, with a wrapping film.

In the drawings, a wrapped state of the wrapping film 1 is the same as in the first and the second embodiments, and hence detailed descriptions thereof will be omitted.

In the wrapped article according to this invention, a first slit 26 is formed on the upper folded portion 13A of the side seal section 13 substantially at right angles to the edge of that upper folded portion. Two slits 27 are formed on the lower folded portion 13B substantially at right angles to the edge of the lower folded portion in line with the first slit 26.

Initially, the first slit 26 and the second slits 27 are peeled off with fingers or the like, and are pulled in the A direction. In a side seal section 13, the wrapping film 1 is welded into a double layer, and the side seal section 13 has a larger strength compared to the rest of the film. Hence, the wrapping film 1 splits along the side seal section 13 as shown in FIG. 28.

When the end 13*a* of the side seal section 13 which is torn as shown in FIG. 28 is peeled in the X direction designated by an arrow, the split stretches along the imaginary lines 8 and 9 over the film 1. This causes the side seal section 13 to be torn off substantially completely, so that the film 1 is opened much wider as shown in FIG. 29.

Figure 29:
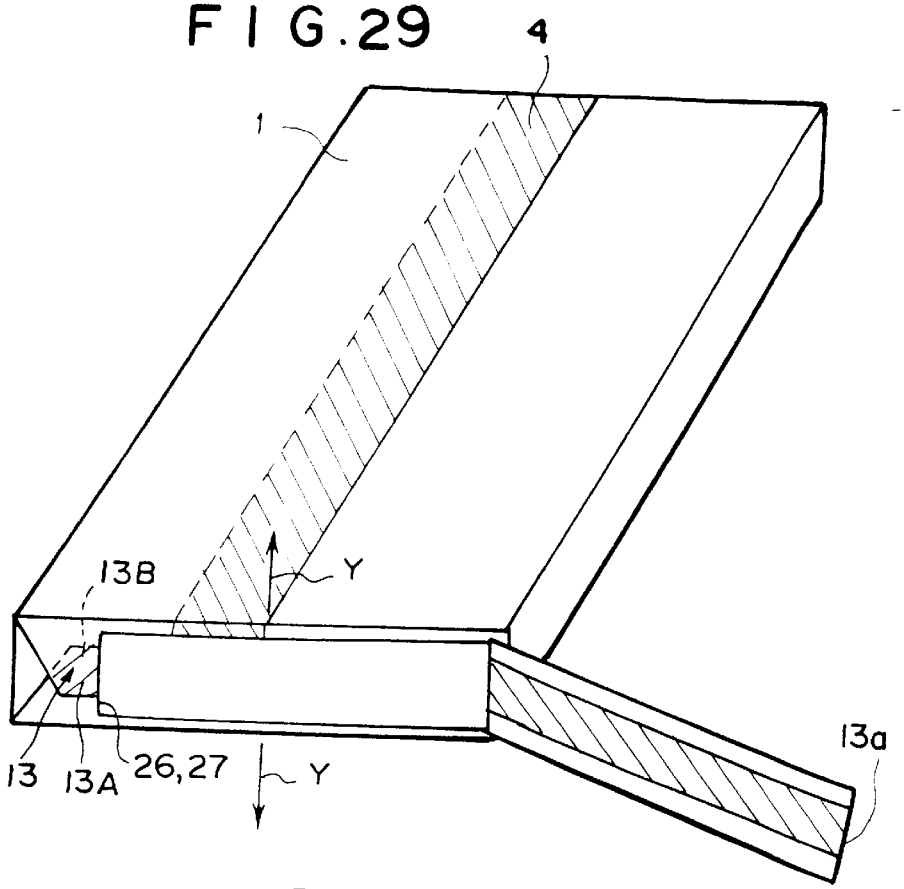
FIG. 29 is a schematic representation of the article shown in FIG. 27 when the split end of the side seal section is further pulled.

The split thus made is pulled in a Y direction as shown in FIG. 29, so that the wrapping film 1 is opened much wider from this split. Thereby, the film 1 can be very easily removed such that the entire article 10 is substantially completely uncovered.

In the case of an existing wrapped article, it is relatively difficult for a user to remove a larger piece of film remaining after the film has been separated by the use of a tearing tape. Compared with this, the wrapped article of this invention enables a very effective removal operation, and also eliminates the necessity to use the tearing tape. This renders the wrapped article very cost effective.

Though the first slit 16 and the slits 17 may be formed after the article 10 has been packed, it is desirable for the slits to be made before the article 10 is packed, thus removing the risk of damage to the article 10 by a cutting knife, etc.

Tenth Embodiment

Figure 30:
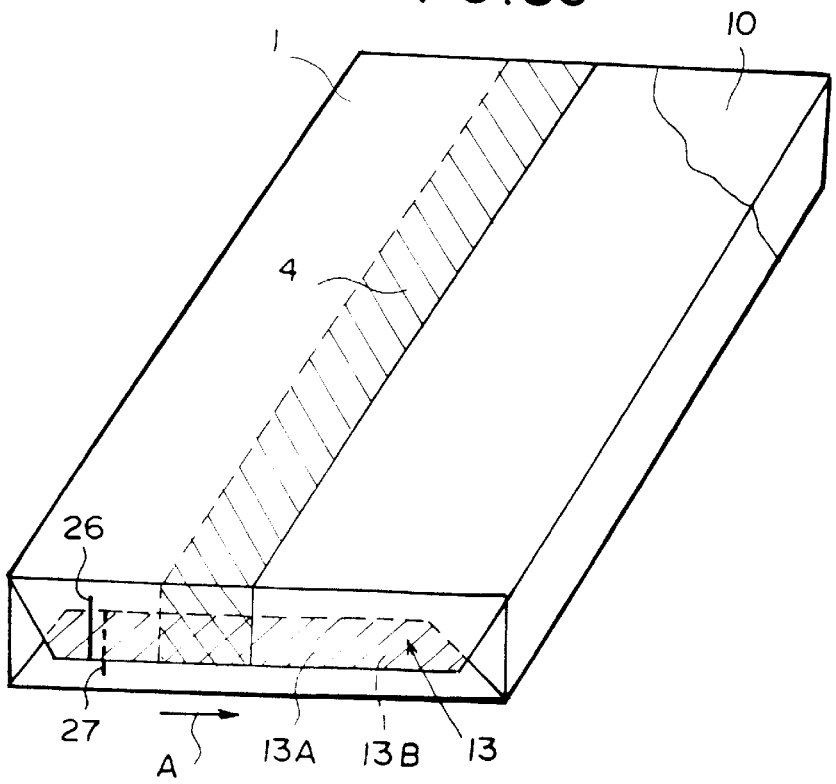
FIG. 30 is a schematic representation of a wrapped article according to a tenth embodiment of this invention.
Figure 31:
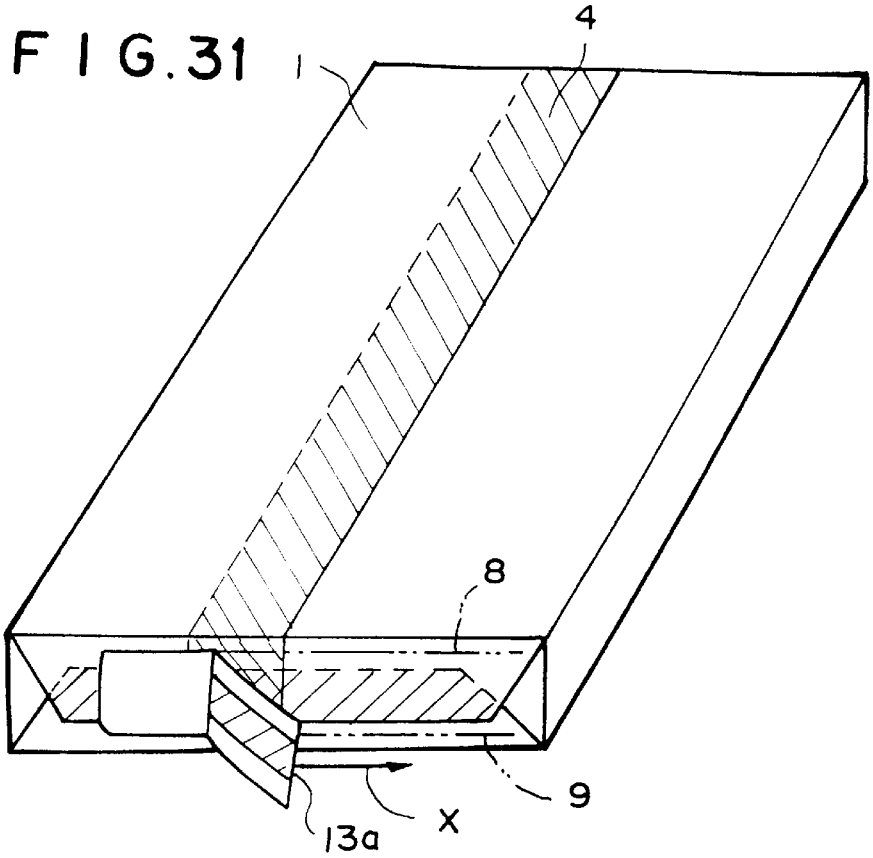
FIG. 31 is a schematic representation of the article shown in FIG. 30 when the split end of the side seal section is raised.

A tenth embodiment will now be described. FIGS. 30 and 31 show a wrapped article according to this embodiment. As illustrated in the drawings, the wrapped article of this embodiment is provided with the body seal section 4 and the side seal section 13 in the same manner as in the ninth embodiment, and hence detailed explanations thereof will be omitted.

A first slit 26 is formed in the upper folded portion 13A of the side seal section 13 substantially at right angles to the edge of the upper folded portion. A second slit 27 is also formed substantially at right angles to the edge of this lower folded portion 13B at a position slightly spaced away from the first slit 26. Such a positional difference between the first slit 26 and the second slit 27 makes it difficult for dust and dirt to enter the film 1 from the slits 26 and 27.

Initially, the first slit 26 is peeled off with fingers or the like, and pulled in the A direction. Thereby, the upper folded portion 13A splits from the first slit 26, and this split reaches the second slit 27. Then, the lower folded portion 13B splits from this second slit 27. In the side seal section 13, the wrapping film 1 is welded into a double layer, and the side seal section 13 has a larger strength compared to the rest of the film. Hence, the wrapping film 1 splits along the side seal section 13 as shown in FIG. 31.

When the end 13*a* of the side seal section 13 which is torn as shown in FIG. 31 is pulled in the X direction designated by the arrow, the split stretches along the imaginary lines 8 and 9 over the film 1. This causes the side seal section 13 to be torn off substantially completely, so that the film 1 is opened much wider in the same manner as in the ninth embodiment. The film 1 can be very easily removed such that the entire article 10 is substantially uncovered.

Though the first slit 26 may be formed after the article 10 has been packed, it is desirable for the slit to be made before the article 10 is packed, thus removing the risk of damage to the article 10 by a cutting knife, etc. On the other hand, the second slit 27 must be formed on the film 1 in advance of packaging.

In this embodiment, the first slit 26 and the second slit 27 may be spaced as far away from each other as required. In order to assure the split of the film 1 from the side seal section 13, the space should be as small as possible. Hence, the space should preferably be set to not more than 15 mm.

Eleventh Embodiment

Figure 32:
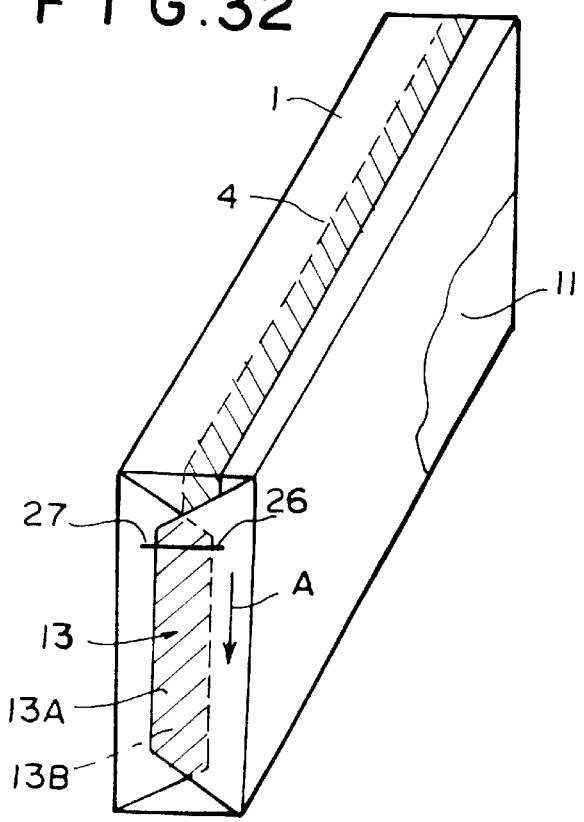
FIG. 32 is a schematic representation of a wrapped article according to an eleventh embodiment of this invention.
Figure 33:
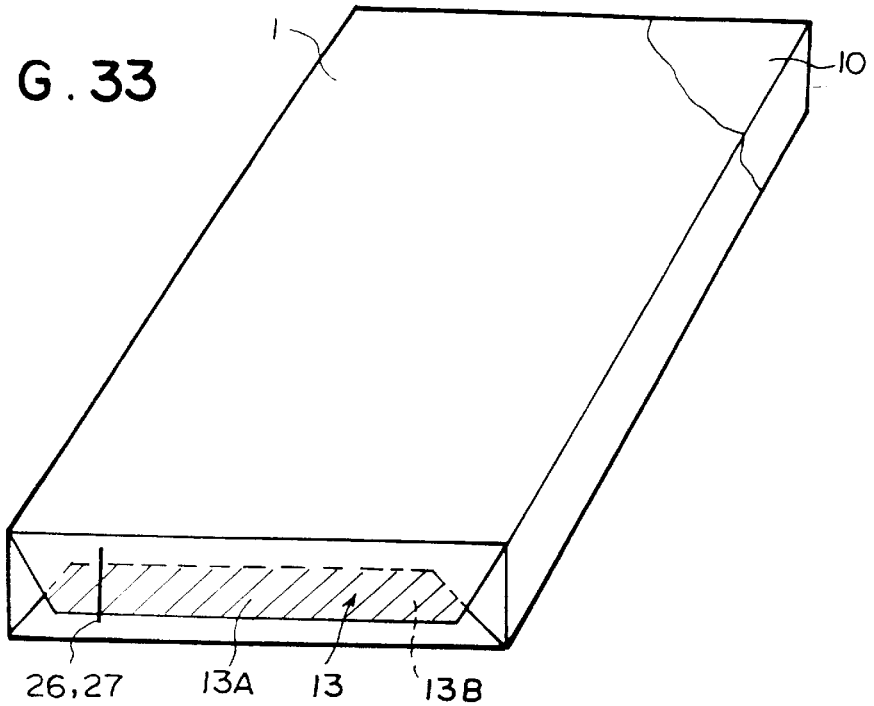
FIG. 33 is a schematic representation of a wrapped article according to a twelfth embodiment of this invention.
Figure 34:
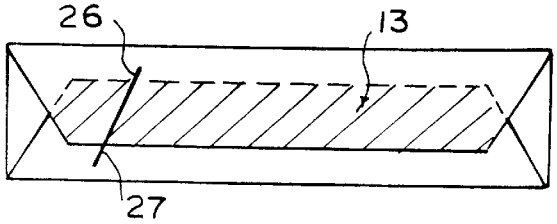
FIG. 34 is a schematic representation of another type of slit according to the ninth to the twelfth embodiments of this invention.

An eleventh embodiment will now be described. FIG. 32 shows a wrapped article according to this embodiment, in which an audio cassette is enclosed, as an article to be wrapped, with a wrapping film. As shown in the drawing, both ends of the wrapping film 1 overlap with each other substantially at the center of a narrow lateral surface of an audio cassette 11 (the cassette is housed in a case) which serves as an article to be wrapped, and heated and lap-welded together to constitute the body seal section 4. Both upper and lower ends of the film 1 extending out of the article 10 are folded to the inside of the article to create the upper folded portion 13A and the lower folded portion 13B. These upper folded portion 13A and the lower folded portion 13B overlap with each other and are lap-welded, thereby constituting the side seal section 13.

As with the ninth embodiment of this invention, the first slit 26 is formed on the upper folded portion 13A of the side seal section 13 substantially at right angles to the edge of the upper folded portion. The second slit 27 is formed on the lower folded portion 13B substantially at right angles to the edge of the lower folded portion in line with the first slit 26.

Initially, the first slit 26 and the second slits 27 are peeled off with fingers or the like, and are pulled in the A direction. The wrapping film 1 splits along the side seal section 13 in the same manner as in the ninth embodiment. Thereby, it is possible to very easily remove the film 1 in such a way that the entire article 11 is substantially uncovered in the same way as in the previous embodiments.

The ninth to eleventh embodiments relate to exemplified examples using a wrapped article in which both ends of a wrapping film overlap with each other substantially at the center of the side wall of an article to be wrapped and are bonded and lap-welded together to constitute a body seal section. However, this invention is not limited to the wrapped articles having the body seal section. For instance, as with the fourth embodiment as shown in FIG. 37, this invention can be applied to wrapped articles in which an article to be wrapped 10 is enclosed with the use of a tube-like wrapping film 1 and only a side seal section 13 is formed.

In the ninth to eleventh embodiments, the first and second slits are formed substantially at right angles to the edge of the body seal section. However, the first and second slits 26 and 27 may be formed at an inclined angle to the edge of the upper and lower folded portions.

Figure 35:
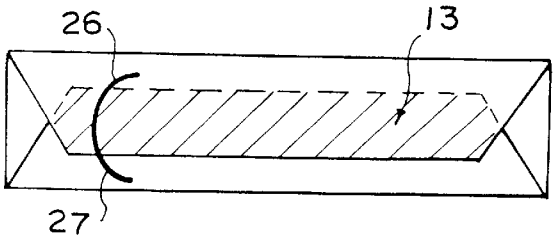
FIG. 35 is a schematic representation of still another type of slit according to the ninth to the twelfth embodiments of this invention.
Figure 36:
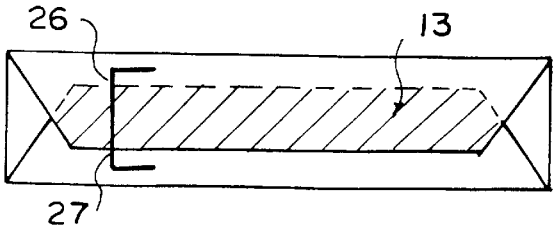
FIG. 36 is a schematic representation of still another type of slit according to the ninth to the twelfth embodiments of this invention.

Moreover, in the ninth to eleventh embodiments, the first and second slits are linearly formed. However, as shown in FIG. 35, the first and second slits 26 and 27 may be U-shaped or formed into the shape of a key as shown in FIG. 36, thereby facilitating the peeling of the first and second slits 26 and 27 with fingers. These shapes of the slits can be applied to the tenth and eleventh embodiments set forth above.

Figure 37:
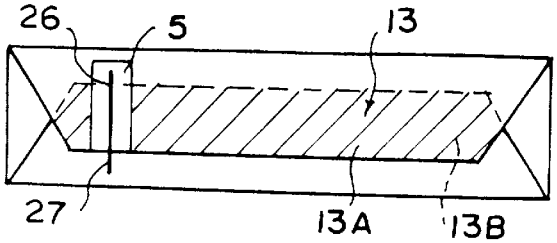
FIG. 37 is a schematic representation of still another type of slit according to the ninth to the twelfth embodiments of this invention.
Figure 38:
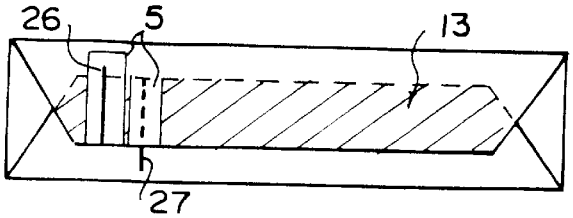
FIG. 38 is a schematic representation of still another type of slit according to the ninth to the twelfth embodiments of this invention.

The unbonded part 5 where the upper folded portion 13A and the lower folded portion 13B are not bonded with each other may be formed around the first and second slits in the side seal section as shown in FIG. 37. Also, as shown in FIG. 38, unbonded parts 5 and 5' should preferably be formed around the slits 26 and 27, respectively, when the first and second slits 26 and 27 are spaced apart from each other. Thus, the unbonded part 5 makes it easy for a finger to peel the first and second slits 26 and 27, whereby the opening of the wrapping film can be easily performed.

Figure 39:
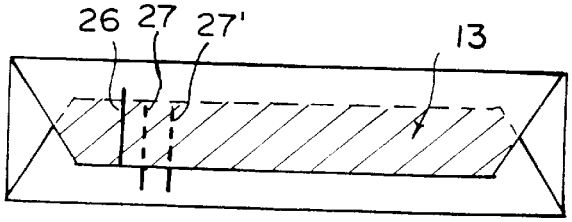
FIG. 39 is a schematic representation of still another type of slit according to the ninth to the twelfth embodiments of this invention.

In the tenth embodiment, the second slit is formed alone. However, the present invention is not limited to this constitution. For instance, as shown in FIG. 39, two second slits 27 and 27' may be formed. Thus, if the more than two second slits are formed, the opening of the film from the side seal section becomes much easier for a user to perform.

Figure 40:
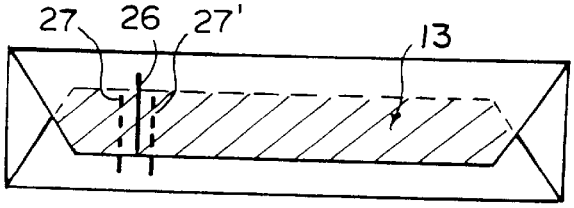
FIG. 40 is a schematic representation of still another type of slit according to the ninth to the twelfth embodiments of this invention.

In the case of the wrapped article having the more than two second slits, the second slits 27 and 27' should preferably be positioned on both sides of the first slit 26 as shown in FIG. 40. These second slits positioned on both sides of the first slit allows the side seal section 13 to be opened in any directions so long as a split stretches along the side seal section 13.

Figure 41:
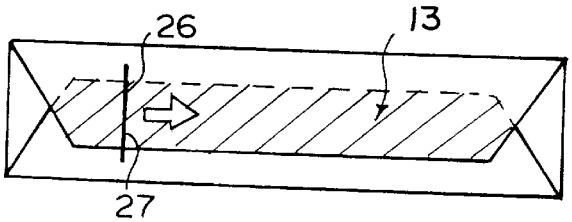
FIG. 41 is a schematic representation of a slit which is provided with a mark according to the ninth to the twelfth embodiments of this invention.
Figure 42:
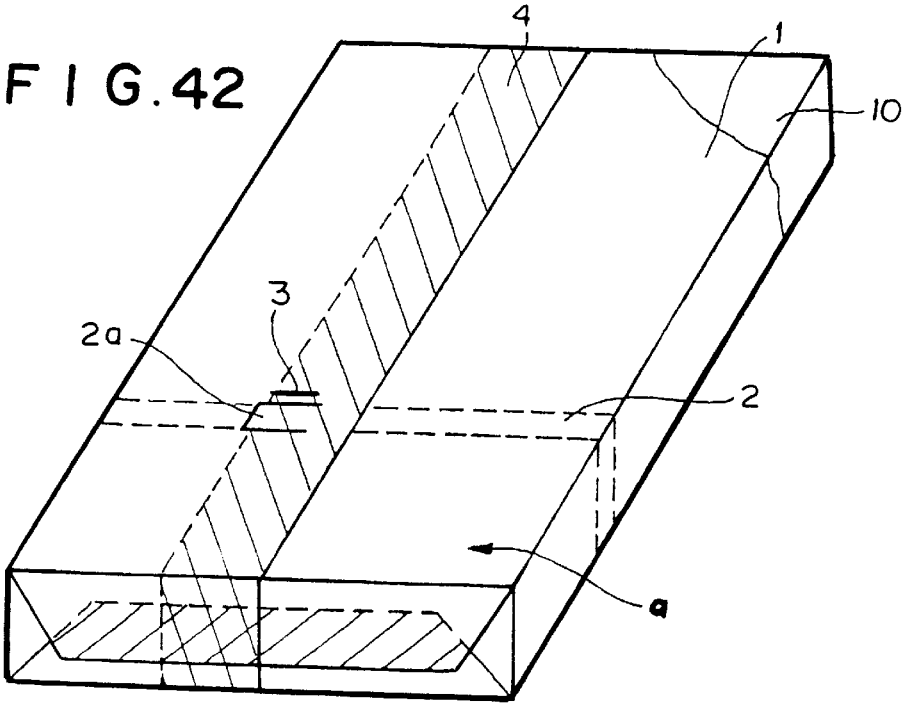
FIG. 42 is a schematic representation showing a conventional wrapped article.

In order to make distinctive the position of the slit and a direction in which the slit is to be peeled off, the wrapping film may be provided with a mark 20, for example, an arrow to indicate the position of the first slit 26 as shown in FIG. 41.

In the previous embodiments, parallelepiped-shaped articles such as the video cassette and the audio cassette are used as the article to be wrapped. However, the article is not limited to them. The article according to this invention can be applied to articles in any shapes such as a sphere, a rectangular parallelepiped, a cylinder, or a circular cone, so long as they can be enclosed with a wrapping film.

Several embodiments of the invention have now been described in detail. It is to be noted, however, that these descriptions of specific embodiments are merely illustrative of the principles underlying the inventive concept. It is contemplated that various modifications of the disclosed embodiments, as well as other embodiments of the invention will, without departing from the spirit and scope of the invention, be apparent to those who are versed in the art.

What is claimed is:

1. A wrapped article comprising:

an article whose outer surface is covered with a shrunk wrapping film, a body seal section made by making ends of the wrapping film overlap with each other and bonding them together, at least one side seal section produced by making an upper folded part and a lower folded part, said upper and lower folded parts being formed by respectively folding upper and lower edges of the film which extend past the article at one end of said article, towards said article, making said edges overlap with each other and bonding them together, and perforations formed around said side seal section to at least substantially surround said side seal section, said perforations forming a path on the same side of said article as said side seal section which surrounds more than three sides of said side seal section, said path leaving an unperforated part of said wrapping film between the beginning and ending points of said path.

2. A wrapped article as defined in claim 1, wherein the unperforated part is positioned at the location corresponding to the body seal section.

3. A wrapped article as defined in claim 1, wherein a slit is formed at least in one part of the perforations.

4. A wrapped article as defined in claim 1, wherein a slit is formed at least in one part of the perforations.

5. A wrapped article as defined in claim 2, wherein a slit is formed at least in one part of the perforations.

6. A wrapped article as defined in claim 1, wherein said perforations are formed in said wrapping film away from the edges of said article which define the borders of said one end of said article.

* * * * *